US011738926B2

(12) United States Patent
Ansola, III

(10) Patent No.: US 11,738,926 B2
(45) **Date of Patent: *Aug. 29, 2023**

(54) DRINK CUP CARRIER

(71) Applicant: Drink Carrier LLC, Pacific, WA (US)

(72) Inventor: Maximo Ansola, III, Pacific, WA (US)

(73) Assignee: Drink Carrier LLC, Pacific, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/891,038

(22) Filed: Aug. 18, 2022

(65) Prior Publication Data

US 2023/0159244 A1 May 25, 2023

Related U.S. Application Data

(63) Continuation-in-part of application No. 17/554,492, filed on Dec. 17, 2021, now Pat. No. 11,420,786, which is a continuation-in-part of application No. 29/816,776, filed on Nov. 24, 2021, and a continuation-in-part of application No. 29/816,779, filed on Nov. 24, 2021, and a continuation-in-part of application No. 29/816,777, filed on Nov. 24, 2021.

(51) Int. Cl.
*B65D 71/62* (2006.01)

(52) U.S. Cl.
CPC ..... *B65D 71/004* (2013.01)

(58) Field of Classification Search
CPC .. B65D 5/5038; B65D 5/0535; B65D 5/5061; B65D 5/5059; B65D 5/50; B65D 71/42; B65D 71/46; B65D 71/40; B65D 71/48; B65D 71/72; B65D 71/70; B65D 71/50; B65D 2571/00444; B65D 2571/0066; B65D 2571/00654
See application file for complete search history.

(56) References Cited

U.S. PATENT DOCUMENTS 3,565,323 A * 2/1971 Katzenmeyer ..... B65D 71/004 229/117.14
3,868,140 A 2/1975 Gordon
4,706,814 A 11/1987 Baugus et al.
(Continued)

FOREIGN PATENT DOCUMENTS

DE 20 2014 105 081 U1 3/2016

OTHER PUBLICATIONS

"Corrugated Cardboard Box Coffee Drink 2 4 Cup Holder Tray Cup Carrier Paper Cup Holders," [<https://www.alibaba.com/productdetail/Corrugated-Cardboard-Box-Coffee-Drink-2_1600102983880.html>, retrieved Sep. 8, 2021], 1 page.
(Continued)

*Primary Examiner* — Javier A Pagan
(74) *Attorney, Agent, or Firm* — SEED INTELLECTUAL PROPERTY LAW GROUP LLP

(57) ABSTRACT

A foldable drink cup holder that holds up to a dozen or more beverage cups as well as straws, and provides multiple layers of horizontal stabilization for the cups in addition to providing large footprints for text and graphics, including angled and square-cut corners structured to abut against each other when the holder is in a folded configuration to provide a flat side that is rigid and stable when holding multiple filled drink cups and straws. A non-foldable unitary cup drink holder with straw holders and handholds is also provided.

14 Claims, 32 Drawing Sheets

(56) References Cited

U.S. PATENT DOCUMENTS

| | | | | |
|---|---|---|---|---|
| 5,358,116 | A | 10/1994 | Brintazzoli | |
| 6,059,099 | A | 5/2000 | Galbierz | |
| 6,168,012 | B1 | 1/2001 | Galbierz | |
| 6,702,115 | B1 | 3/2004 | Roper | |
| D871,924 | S | 1/2020 | Vanderwell et al. | |
| D881,021 | S | 4/2020 | Bandinu | |
| 2006/0278559 | A1 | 12/2006 | Hamblin et al. | |
| 2009/0242717 | A1 | 10/2009 | Stonehouse | |
| 2010/0127058 | A1* | 5/2010 | Bates | B65D 71/004 229/117.13 |
| 2019/0177031 | A1 | 6/2019 | Vanderwell et al. | |

OTHER PUBLICATIONS

"Customized Print Hot Drink Takeaway Cups Carrier Foldable Paper Cup Holder Tray," OOLIMAPACK, [https://www.alibaba.com/productdetail/Cups-Paper-Cup-Holder-Customized-Print_1600181217480.html?spm=a2700.7724857.topad_classic.d_title.143911e7JTGzP4>, retrieved Sep. 8, 2021], 1 page.

* cited by examiner

DRINK CUP CARRIER

BACKGROUND

Technical Field

The present disclosure is directed to holders designed to accommodate one or more beverage cups and, more particularly, to a portable custom cup carrier that holds up to a dozen or more beverage cups as well as straws, and, in one aspect is foldable, in addition to providing large footprints for text and graphics.

Description of the Related Art

Many consumers purchase carry-out beverages that are intended to be consumed at a location remote from the point of purchase, such as in moving vehicles, at the office, home, and elsewhere. When multiple drinks are purchased by one consumer on behalf of others who are not present, the issue for the consumer is how to carry more than two beverage cups at one time.

Cup holders have been developed that are lightweight, disposable, and provide minimal support for the cups. They are typically composed of molded pulp that easily weakens when it becomes wet. Raised rings are formed on a flat base to receive the bottom of a cup, and these rings are restricted to one-size-fits all. The raised rings provide little to no horizontal support for the cups, allowing the cups to easily tip over when subjected to a lateral load, such as when the carrier is handed to the consumer through a window, or when a vehicle goes around a corner. No accommodation is made for holding straws, which typically accompany a disposable beverage cup, and these cup holders lack handles.

BRIEF SUMMARY

The present disclosure is, in one aspect, directed to a custom foldable drink cup carrier that addresses the foregoing deficiencies in current cup holders. The present disclosure is, in another aspect, directed to a non-foldable, portable, handholdable drink cup carrier that addresses the foregoing deficiencies in current cup holders.

In accordance with one aspect of the present disclosure, a foldable carrier is provided for drink cups that includes:

- a top panel having a plurality of drink cup openings;
- a front panel extending from the top panel;
- a bottom panel extending from the front panel;
- a rear support panel extending from the bottom panel;
- a middle panel having a plurality of drink cup openings, the middle panel structured to fold over the bottom panel in a folded over configuration; and
- the top panel structured to fold over the middle panel to place the foldable carrier in a folded configuration in which the plurality of drink cup openings in the top panel are positioned in concentric alignment with the plurality of drink cup openings in the middle panel.

In accordance with another aspect of the present disclosure, the foldable carrier includes at least one opening in the top panel and at least one corresponding opening in the middle panel that are structured to be concentric when the top panel is in the folded configuration, the opening in the top panel and the corresponding opening in the middle panel sized and shaped to accommodate a plurality of straws according in number to a number of the plurality of drink cup openings in the top panel.

In accordance with yet another aspect of the present disclosure, each drink cup opening of the plurality of drink cup openings in the top panel includes at least one bendable tab extending from the top panel into the opening, the at least one bendable tab sized and shaped to frictionally engage the drink cup.

In accordance with still another aspect of the present disclosure, each drink cup opening of the plurality of drink cup openings in the middle panel includes at least one bendable arcuate tab extending from the middle panel into the opening, the at least one bendable arcuate tab sized and shaped to frictionally engage the drink cup.

In accordance with another aspect of the present disclosure, a foldable carrier is provided for drink cups that includes:

- a single sheet of foldable material that is formed to comprise:
  - a top panel having a front bend line, a rear bend line, a right bend line, and left bend line, the top panel having a plurality of drink cup openings;
  - a front panel extending from the front bend line on the top panel;
  - a rear panel flap extending from the rear bend line on the top panel;
  - a right side exterior flap extending from the right bend line on the top panel;
  - a bottom panel having a bottom front bend line, a bottom rear bend line, a bottom right bend line, and a bottom left bend line, the bottom panel extending from the front panel at the bottom front bend line;
  - a right side interior flap extending from the bottom right bend line on the bottom panel;
  - a left side interior flap extending from the bottom left bend line on the bottom panel;
  - a rear support panel extending from the bottom rear bend line on the bottom panel; and
  - the top panel structured to fold over the bottom panel to place the foldable carrier in a folded configuration in which the top panel is positioned in alignment with the bottom panel.

In accordance with a further aspect of the present disclosure, the foldable carrier further includes a right back tab extending from the rear panel flap, a left back tab extending from the rear panel flap, a right back tab slit formed in the bottom rear bend line, and a left back tab slit formed in the bottom rear bend line, the left back tab and right back tab sized and shaped to be slidably received in the right back tab slit and left back tab slit, respectively, to hold the top panel in place and the foldable carrier in the folded configuration.

In accordance with another aspect of the present disclosure, the foldable carrier further includes a left side tab slit formed in the bottom left bend line on the bottom panel, a right side tab slit formed in the bottom right bend line on the bottom panel, a left side tab extending from the left side exterior flap on the top panel, and a right side tab extending from the right side exterior flap, the left side tab and right side tab sized and shaped to be slidably received in the left side tab slit and the right side tab slit, respectively, to hold the top panel in place and hold the foldable carrier in the folded configuration.

In accordance with another aspect of the present disclosure, the foldable carrier further includes a top right hand hold opening formed in the right side exterior flap, a top left hand hold opening formed in the left side exterior flap, a right side hand hold opening formed in the right side interior flap, a left side hand hold opening formed in the left side interior flap, the top right hand hold opening and the right side hand hold opening structured to overlap and the top left hand hold opening and the left side hand hold opening structured to overlap when the foldable carrier is in the folded configuration.

In accordance with another aspect of the present disclosure, the foldable carrier includes at least one opening in the top panel sized and shaped to accommodate a plurality of straws corresponding in number to a number of the plurality of drink cup openings in the top panel.

In accordance with yet another aspect of the present disclosure, the right side interior flap has a right side front angled corner edge and a right side rear angled corner edge, the left side interior flap has a left side front angled corner edge and a left side rear angled corner edge, and the front panel has a right side angled corner edge and a left side angled corner edge that are sized and shaped to butt against the right side front angled corner edge and the left side front angled corner edge, respectively, in response to the top panel being folded over the bottom panel.

In accordance with another aspect of the present disclosure, the right side front angled corner edge and the left side front angled corner edge are on the right side and left side interior flaps, respectively, the right side angled corner edge and the left side angled corner edge on the front panel are all formed at a 45-degree angle to the bottom front bend line, and the right side rear angled corner edge and the left side rear angled corner edge on the right side and left side interior flaps, respectively, are formed at a 45-degree angle to the bottom rear bend line.

In accordance with another aspect of the present disclosure, the rear panel flap has a right side top angled corner edge and a left side top angled corner edge that are sized and shaped to butt against the right side rear angled corner edge and the left side rear angled corner edge, respectively, when the top panel is folded over the bottom panel.

In accordance with another aspect of the present disclosure, the right side top angled corner edge and the left side top angled corner edge are formed at a 45-degree angle to the right bend line and the left bend line, respectively.

In accordance with yet another aspect of the present disclosure, a right side interior flap has a right side interior corner adjacent the right side front angled corner edge and a left side interior flap has a left side interior corner adjacent the left side front angled corner edge, and the front panel has a right side exterior corner adjacent the right side angled corner edge and a left side exterior corner adjacent the left side angled corner edge that are sized and shaped to fit within the right side interior corner and left side interior corner, respectively, when the top panel is folded over the bottom panel.

In accordance with a further aspect of the present disclosure, the right side interior flap has a right side rear interior corner adjacent the right side rear angled corner edge and the left side interior flap has a left side rear interior corner adjacent the left side rear angled corner edge, and the rear panel flap has a right side top exterior corner adjacent the right side top angled corner edge and a left side top exterior corner adjacent the left side top angled corner edge, such that the right side top exterior corner and the left side top exterior corner are sized and shaped to fit within the right side rear interior corner and the left side rear interior corner when the top panel is folded over the bottom panel and the foldable carrier is in the folded configuration.

In accordance with yet another aspect of the present disclosure, the right side top exterior corner on the rear panel flap forms a 135-degree angle with the adjacent right side top angled corner edge and the left side top exterior corner forms a 135-degree angle with the adjacent left side top angled corner edge, such that the right side exterior corner on the front panel forms a 135-degree angle with the adjacent right side angled corner edge, and the left side exterior corner on the front panel forms a 135-degree angle with the adjacent left side angled corner edge.

In accordance with yet another aspect of the present disclosure, each opening in the plurality of drink cup openings in the top panel includes at least one bendable tab extending from the top panel into the opening, the at least one bendable tab sized and shaped to frictionally engage the drink cup.

In accordance with another aspect of the present disclosure, a foldable carrier is provided for drink cups that includes:

- a top panel having a plurality of drink cup openings;
- a front panel extending from the top panel;
- a bottom panel extending from the front panel;
- a rear support panel extending from the bottom panel; and
- the top panel structured to fold over the bottom panel to place the foldable carrier in a folded configuration in which the top panel is positioned in alignment with the bottom panel.

In accordance with another aspect of the present disclosure, the top panel has a front bend line, a rear bend line, a right bend line, and a left bend line, the front panel extending from the front bend line; and the bottom panel has a bottom front bend line, a bottom rear bend line, a bottom right bend line, and a bottom left bend line, the bottom panel extending from the front panel at the bottom front bend line.

In accordance with yet still another aspect of the present disclosure, a rear panel flap extends from the rear of the top panel, a right side exterior flap extends from the right side of the top panel, a left side exterior flap extends from the left side of the top panel, a right side interior flap extends from the right side of the bottom panel; and a left side interior flap extends from the left side of the bottom panel.

In accordance with a further aspect of the present disclosure, a handholdable, portable, non-foldable carrier is provided for drink cups that includes:

- a receptacle having a top panel;
- a plurality of drink cup openings formed in the top panel;
- each drink cup opening having an octagonal, planform shape; and
- at least one tab extending from the top panel into each drink cup opening, the at least one tab sized and shaped to frictionally engage the drink cup.

In accordance with another aspect of the present disclosure, the receptacle is formed of material comprising at least one from among the group of polypropylene, polyethylene lined, polystyrene enhanced, polyactic acid, and a mixture of two or more of the foregoing.

In accordance with yet a further aspect of the present disclosure, the non-foldable carrier includes:

- a right side panel extending from the right side of the top panel;
- a left side panel extending from the left side of the top panel;
- a front side panel extending from the front side of the top panel; and
- a rear side panel extending from the rear side of the top panel, where the right side panel, left side panel, front side panel and rear side panel are each positioned at an angle to the top panel, thereby creating an enclosed space beneath the top panel.

In accordance with still another aspect of the present disclosure, the bottom panel has a plurality of drink cup openings that are in concentric alignment with the plurality of drink cup openings in the top panel.

In accordance with yet another aspect of the present disclosure, the non-foldable carrier includes at least one opening in the top panel and at least one opening in the bottom panel, the opening in the top panel and the opening in the bottom panel being sized and shaped to accommodate a plurality of straws corresponding in number to a number of the plurality of drink cup openings in the top panel, and the opening in the top panel and the opening in the bottom panel being positioned in concentric alignment with each other.

BRIEF DESCRIPTION OF THE SEVERAL VIEWS OF THE DRAWINGS

The foregoing features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with the manufacture of packaging, such as cardboard packaging, have not been shown or described in order to avoid unnecessarily obscuring descriptions of the representative implementations herein below.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

Figure 1:
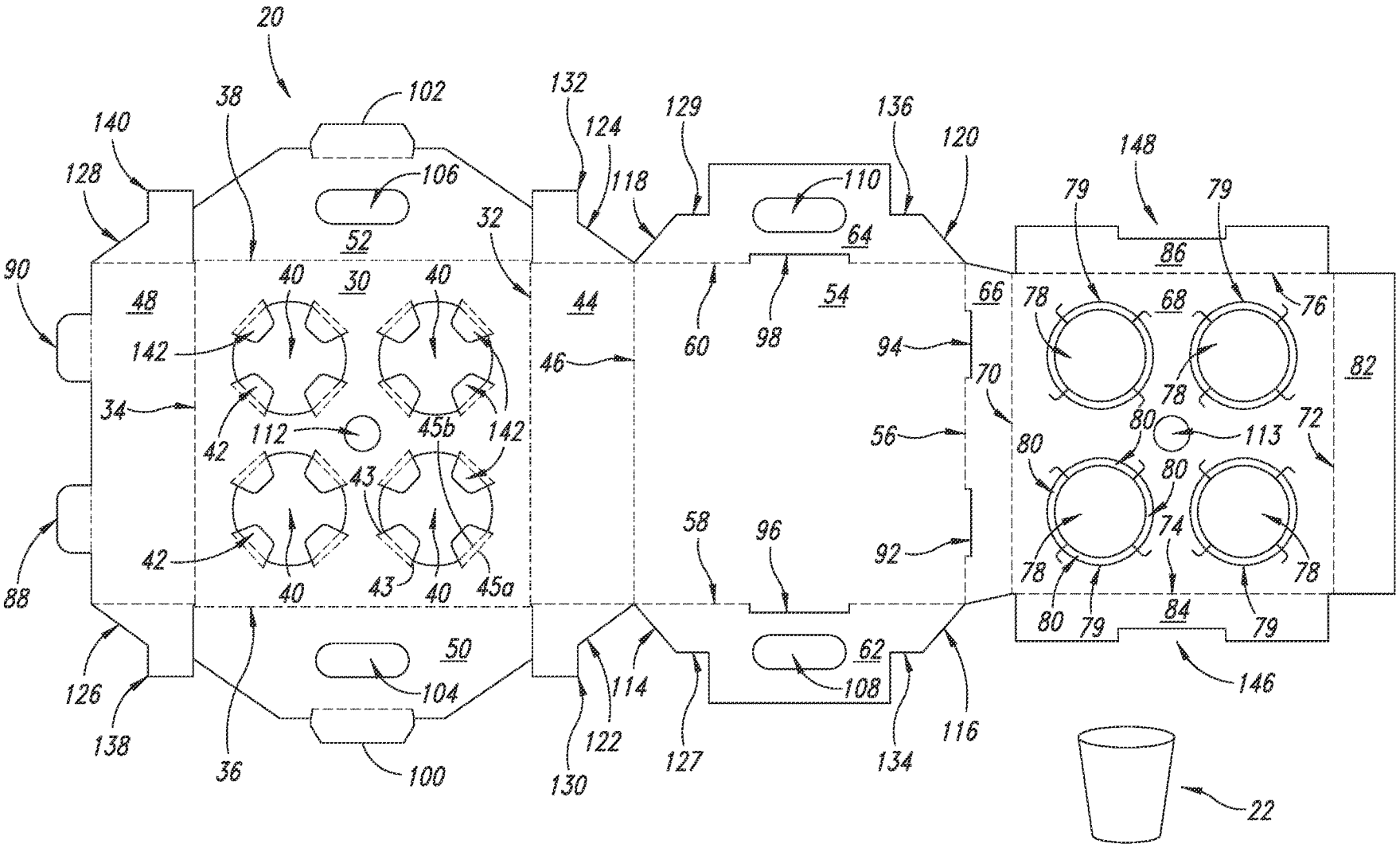
FIGS. 1-3 are top plan views of the foldable beverage cup carriers, respectively, in an unfolded, flattened configuration in accordance with the present disclosure.
Figure 2:
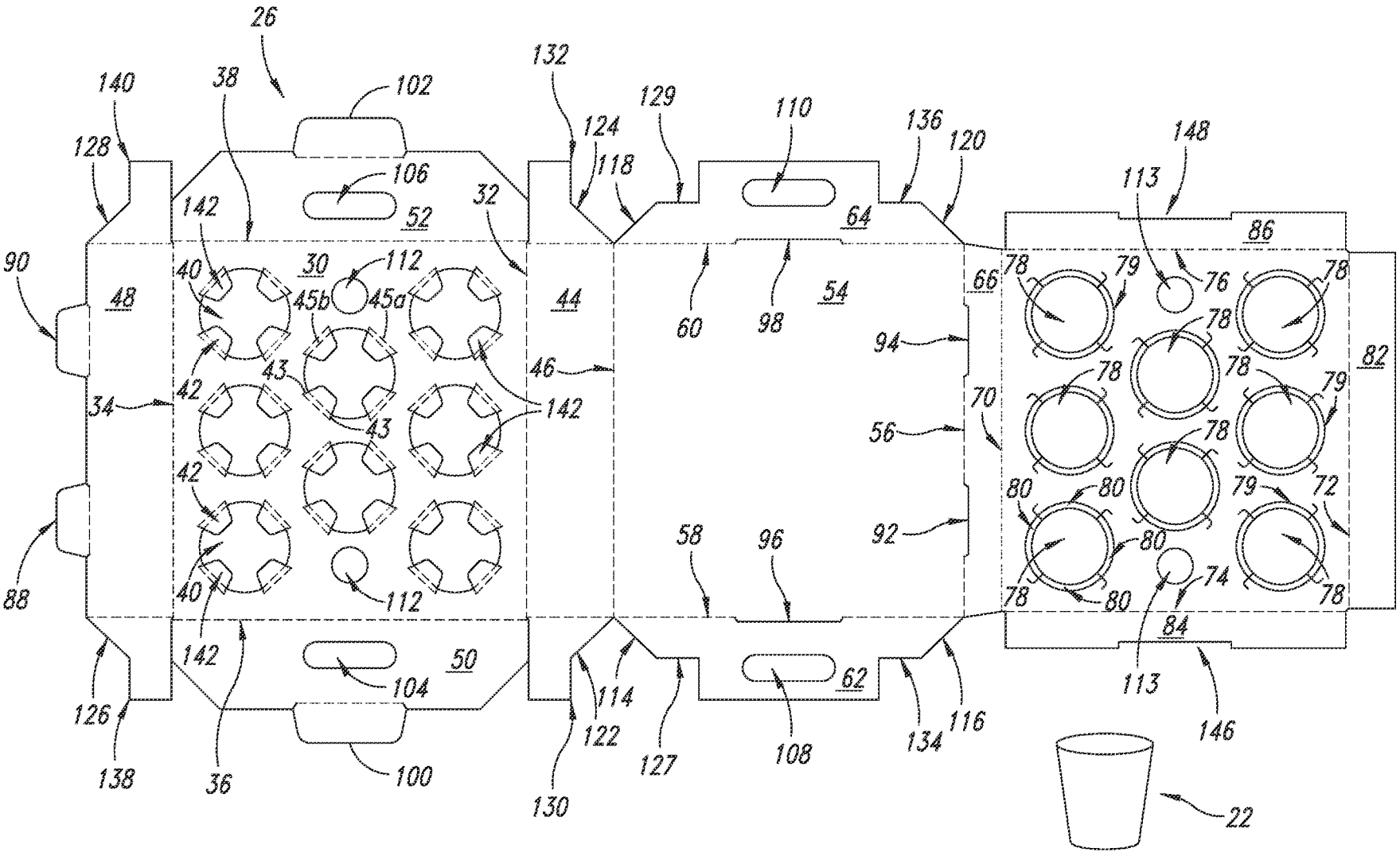
Figure 3:
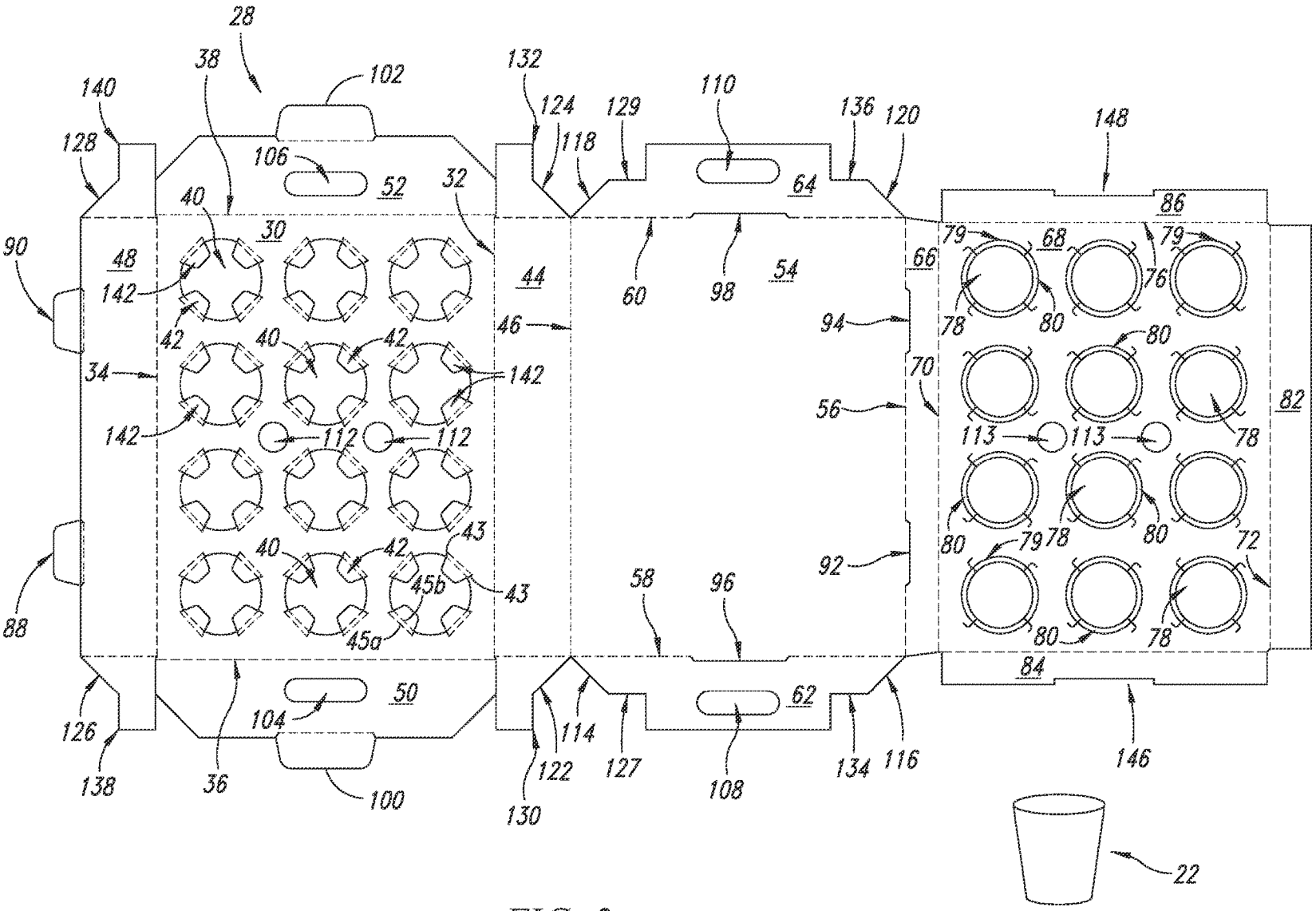
Figure 4:
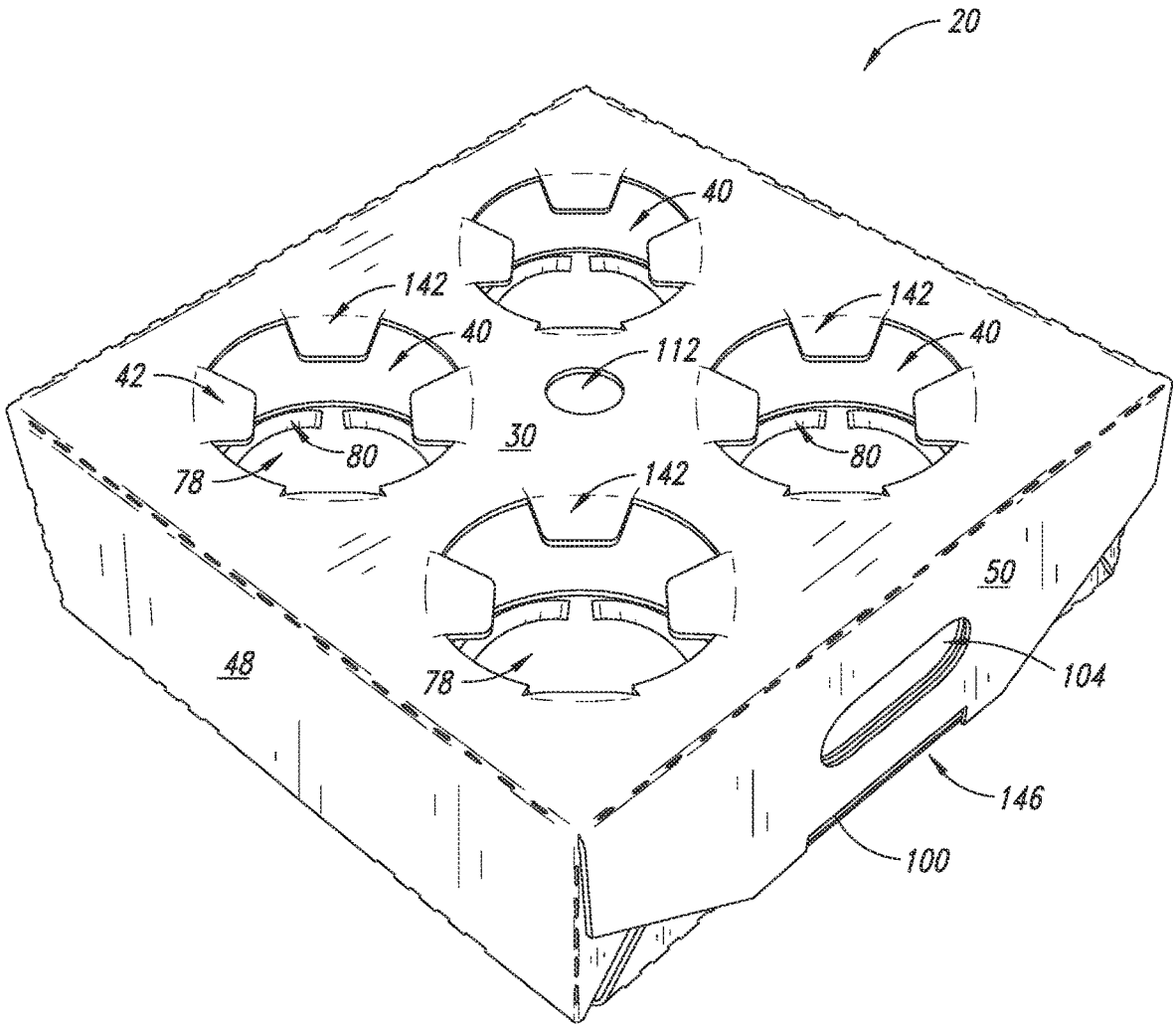
FIGS. 4-6 are axonometric illustrations of assembled foldable beverage cup carriers for four cups, eight cups, and twelve cups, respectively, in accordance with the present disclosure.
Figure 5:
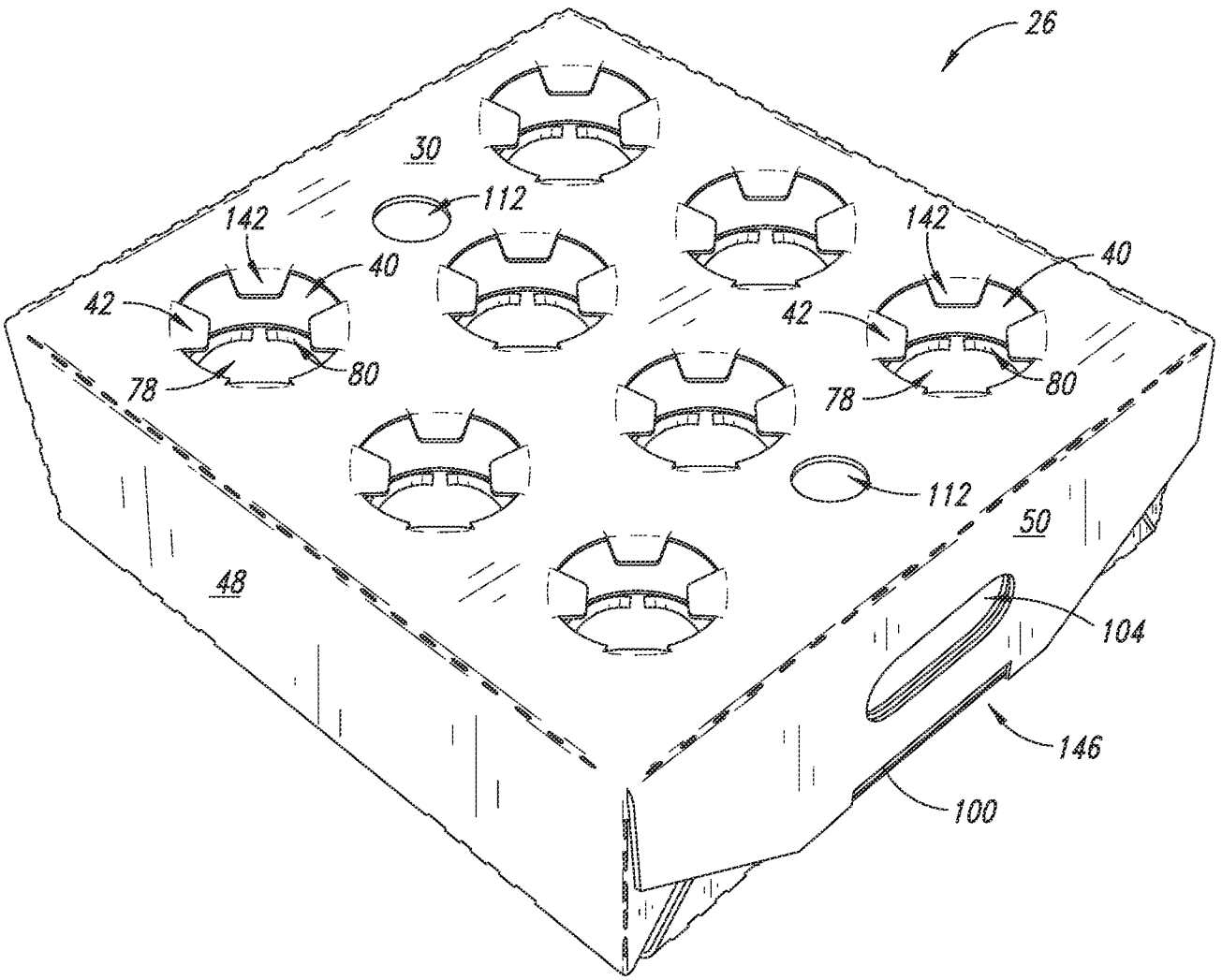
Figure 6:
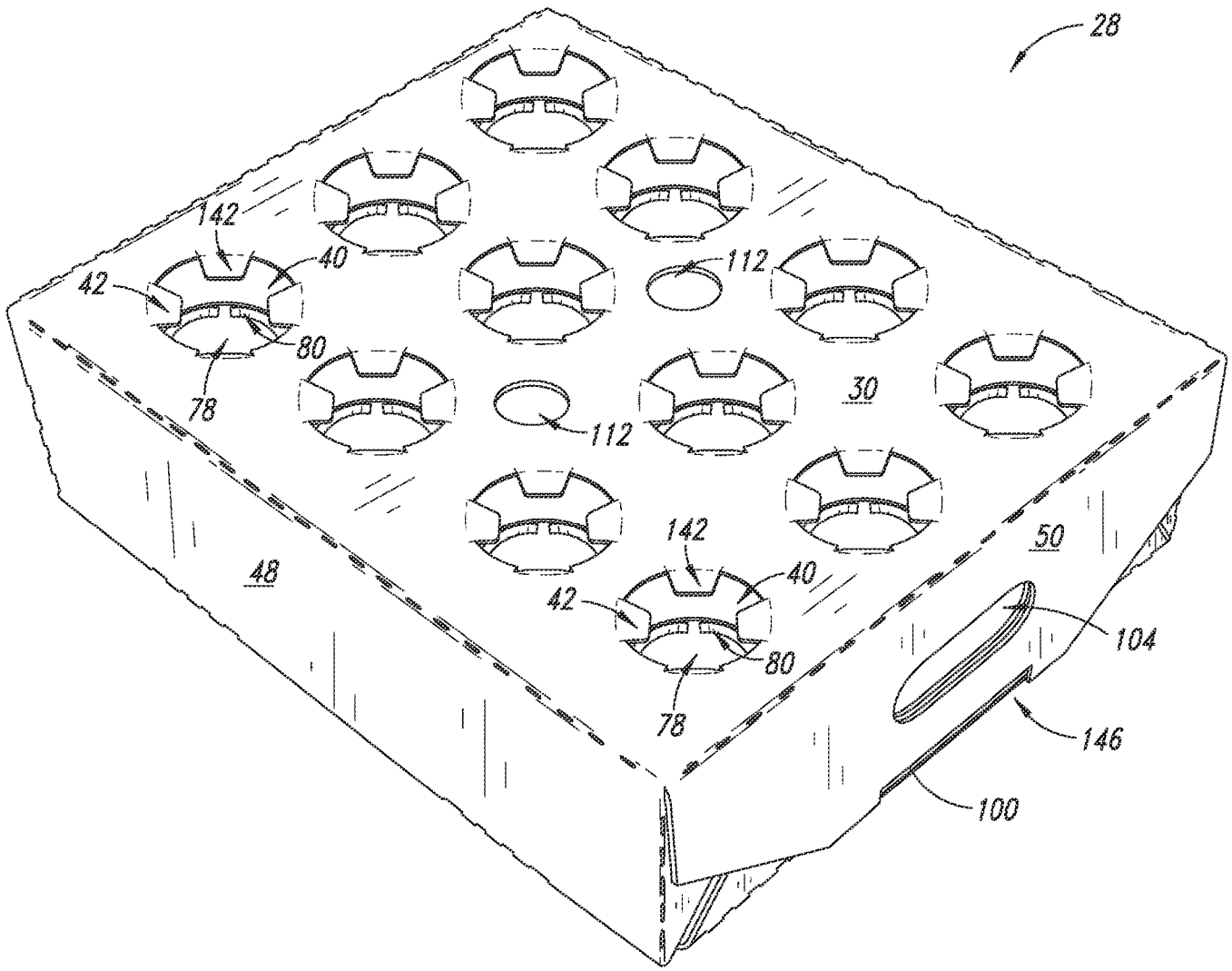

Referring to FIG. 1, shown therein is a flattened foldable carrier 20 for drink cups 22. The assembled carrier 20 is shown in FIG. 4, which in this case is a four-cup foldable drink cup carrier 20 designed to hold up to four drink cups 22 and four straws (not shown). FIGS. 2 and 3 show the eight-cup flattened foldable carrier 26 and the twelve-cup flattened foldable carrier 28, and the assembled carriers 26 and 28 are shown in FIGS. 5 and 6, respectively. Like features among these three configurations will have the same reference numbers, and the description that follows will initially focus on the four-cup carrier 20 in FIG. 1.

The carrier 20 is constructed of a single sheet of foldable material, ideally corrugated cardboard, although it may be made from plastics, composites, or other materials or combination of the same. The cardboard is die cut to create the flattened carrier 20. In a preferred implementation the foldable four-cup drink cup carrier 20 has nominal dimensions of 10 inches wide by 10 inches long and 3¼ inches high. The carrier 20 includes the following components.

A top panel 30 is shown having a front bend line 32, a rear bend line 34, a right bend line 36, and a left bend line 38. The top panel 30 has a plurality of drink cup openings 40, each opening 40 having a plurality of bendable tabs 42 arranged around the circumference of the opening 40. In this representative embodiment, the opening 40 has a diameter of 3⅜ inches, although that diameter may vary according to intended use. There are four tabs 42 spaced equidistantly around the circumference of each opening 40, with each tab 42 projecting inward to form an inner diameter around the four tabs of 2 inches. This sizing is applied to each of the three carriers 20, 26, 28 described herein. Each tab 42 has two side cuts 43 into the top panel 30 that facilitate bending of the tab 42 into an interior of the carrier 20. There are also two sets of parallel transverse score lines 45*a*, 45*b* on the top and bottom surfaces of where the tab 42 joins the top panel 30. The first set of score lines 45*a* is at the end of the side cuts 43, and the second set of parallel score lines 45*b* is interior to the first set relative to the opening 40. All score lines 45*a*, 45*b*, are about ¼ inch long and are spaced about 3/16 inch from adjacent parallel score lines, both laterally and longitudinally. Again, these dimensions can vary according to intended use.

A front panel 44 is shown extending from the front bend line 32 on the top panel 30, the front panel 44 having a bottom front bend line 46. A rear panel flap 48 extends from the rear bend line 34 on the top panel 30. A right side exterior flap 50 extends from the right side bend line 36 and a left side exterior flap 52 extends from the left bend line 38 on the top panel 30.

A bottom panel 54 is provided that extends from the front panel 44 at the bottom front bend line 46, and includes a bottom rear bend line 56, a bottom right bend line 58, and a bottom left bend line 60. A right side interior flap 62 extends from the right side bend line 58 on the bottom panel 54, and a left side interior flap 64 extends from the left side bend line 60 on the bottom panel 54.

A rear support panel 66 extends from the bottom rear bend line 56 on the bottom panel 54.

A middle panel 68 extends from the rear support panel 66 at a middle front bend line 70, and it includes a middle rear bend line 72, a middle right side bend line 74, and a middle left side bend line 76. The middle panel 68 includes a plurality of drink cup openings 78, in this case four drink cup openings 78 that each have a diameter and a plurality of arcuate bendable tabs 80, in this case four tabs 80, extending from the circumference of the opening 78. The middle level openings are 2¾ inch inside diameter and 3¼ inch outside diameter, with four arcuate tabs 80 sized and shaped to extend completely around the circumference of the opening 78. Each arcuate tab 80 has a width of ¼ inch. The arcuate tabs 80 are attached to the middle panel 68 by a ¼ wide attachment section 79.

A front support flap 82 extends from the middle rear bend line 72 on the middle panel 68. A right side support flap 84 extends from the middle right side bend line 74 and a left side support flap 86 extending from the middle left bend line 76 on the middle panel 68.

The middle panel 68 is structured to fold over the bottom panel 54 in a folded over configuration and be supported at a middle level on the bottom panel 54 by the front support flap 82, the rear support panel 66, the right side support flap 84, and the left side support flap 86.

The top panel 30 is structured to fold over the middle panel 68 and be supported on the bottom panel 54 by the front panel 44, the rear panel flap 48, the right side exterior flap 50, and the left side exterior flap 52, at a top level that is above the middle level of the middle panel 68. This enables placing the foldable carrier 20 in a folded configuration as shown in FIG. 4 in which the plurality of drink cup openings 40 in the top panel 30 are positioned in concentric alignment with the plurality of drink cup openings 78 in the middle panel 68.

The foldable carrier 20 further includes a right back tab 88 extending from the rear panel flap 48, a left back tab 90 extending from the rear panel flap 48, a right back tab slit 92 formed in the bottom rear bend line 56, and a left back tab slit 94 formed in the bottom rear bend line 56. The right back tab 88 and left back tab 90 are sized and shaped to be slidably received in the right back tab slit 92 and left back tab slit 94, respectively, to hold the top panel 30 in place and the foldable carrier 20 in the folded configuration. Both slits 92, 94 are preferably formed to be positioned slightly off the rear bend line 56 and into the rear support panel 66 to accommodate the thickness of the tabs 88, 90. This makes it easier to assemble the carrier 20 and creates a squarer appearance when the carrier 20 is in its folded configuration. In the four-cup carrier 20, these right and left back tabs 88, 90 are about 2 inches wide and 1 inch deep and are not tapered but have rounded corners. The corresponding right and left back tab slits 92, 94 are 2 1/16 inches wide. In the eight-cup carrier 26 and twelve-cup carrier 28, these corresponding back tabs are 2½ inches wide and 1½ inch deep and taper to 2¼ inches wide with rounded corners. The corresponding slits are 3¾ inches wide.

The foldable carrier 20 also includes a right side tab slit 96 formed in the right side bottom bend line 58 on the bottom panel 54, a right side tab slit 96 formed in the right side bottom bend line 58 on the bottom panel 54, a right side tab 100 extending from the right exterior side flap 50 on the top panel 30, and a left side tab 102 extending from the left exterior side flap 52. The right side tab 100 and left side tab 102 are sized and shaped to be slidably received in the right side tab slit 96 and the left side tab slit 98, respectively, to hold the top panel 30 in place and hold the foldable carrier 20 in the folded configuration. Ideally, the right side tab slit 96 and left side tab slit 98 are offset onto their respective right and left side interior flaps 62, 64 a distance sufficient to accommodate the thickness of the right and left side tabs 100, 102, to facilitate folding together of the carrier 20 and presenting a tight, square shape.

In the representative embodiment for the four-cup carrier 20, these right and left side tabs 100, 102 are about 3 inches wide and about 1 inch deep, tapering to the end with rounded corners, and the corresponding slits 96, 98 are about 3 1/16 inches wide. In the eight-cup carrier 26 and the twelve-cup carrier 28, these tabs are 4 inches and tapered to a 3¾ inch width with a depth of 1½ inches, and include rounded corners. The slits for these larger tabs are about 4⅜ inches wide.

Referring still to FIG. 1, the foldable carrier 20 further includes a top right hand hold opening 104 formed in the right side exterior flap 50, a top left hand hold opening 106 formed in the left side exterior flap 52, a right side hand hold opening 108 formed in the right side interior flap 62, and a left side hand hold opening 110 formed in the left side interior flap 64. The top right hand hold opening 104 and the right side hand hold opening 108 are structured to overlap and the top left hand hold opening 106 and the left side hand hold opening 110 are also structured to overlap when the top panel 30 is folded over the middle panel 68 and the foldable carrier 20 is in the folded configuration.

At least one straw opening 112 is formed in the top panel 30 and at least one corresponding straw opening 113 is formed in the middle panel 68 that are structured to be concentric and overlap (to be in alignment) when the top panel 30 is in the folded configuration over the middle panel 68. The straw opening 112 in the top panel 30 and the corresponding straw opening 113 in the middle panel 68 are sized and shaped to accommodate a plurality of straws, generally corresponding in number to the number of drink cup openings 40 in the top panel 30. In the representative embodiments shown herein, the straw openings 112, 113 are 1¼ inch in diameter. It is to be understood that this diameter can be increased or decreased to correspond to the number of straws to be held in place.

To facilitate the folding and maintaining of the carrier 20 in the folded configuration with the sides flat, as shown in FIG. 4, the right side interior flap 62 has a right side front angled corner edge 114 and a right side rear angled corner edge 116, and the left side interior flap 64 has a left side front angled corner edge 118 and a left side rear angled corner edge 120. In addition, the front panel 44 has a right side angled corner edge 122 and a left side angled corner edge 124 that are sized and shaped to butt against the right side front angled corner edge 114 and the left side front angled corner edge 118, respectively, in response to the top panel 30 being folded over the middle panel 68.

Preferably, the right side front angled corner edge 114 and the left side front angled corner edge 118 on the right side and left side interior flaps 62, 64, respectively, and the right side angled corner edge 122 and the left side angled corner edge 124 on the front panel 44 are all formed at a 45-degree angle to the bottom front bend line 46. In addition, the right side rear angled corner edge 116 and the left side rear angled corner edge 120 on the right side and left side interior flaps 62, 64, respectively, are formed at a 45-degree angle to the bottom rear bend line 56.

Moreover, the rear panel flap 48 has a right side top angled corner edge 126 and a left side top angled corner edge 128 that are sized and shaped to butt against the right side rear angled corner edge and the left side rear angled corner edge, respectively, when the top panel 30 is folded over the middle panel 68. Ideally, the right side top angled corner edge 126 and the left side top angled corner edge 128 are formed at a 45-degree angle to the right bend line 36 and the left bend line 38, respectively.

To further enhance the strength and flatness of the sides of the carrier 20 in the folded configuration, the right side interior flap 62 has a right side interior corner 127 adjacent the right side angled corner edge 114 and the left side interior flap 64 has a left side interior corner 129 adjacent the left side front angled corner edge 118. In addition, the front panel 44 has a right side exterior corner 130 adjacent the right side angled corner edge 122 and a left side exterior corner 132 adjacent the left side angle corner edge 124 that are sized and shaped to fit within the right side interior corner 127 and the left side interior corner 129, respectively, when the top panel 30 is folded over the middle panel 68 to facilitate holding the foldable carrier 20 in the folded configuration shown in FIG. 4.

In addition to the foregoing, the right side interior flap 62 has a right side rear interior corner 134 adjacent the right side rear angled corner edge 116, and the left side interior flap 64 has a left side rear interior corner 136 adjacent the left side rear angled corner edge 120. Further, the rear panel flap 48 has a right side top exterior corner 138 adjacent the right side top angled corner edge 126 and a left side top exterior corner 140 adjacent the left side top angled corner edge 128. The right side top exterior corner 138 and the left side top exterior corner 140 are sized and shaped to fit within the right side rear interior corner 134 and the left side rear interior corner 136 when the top panel 30 is folded over the middle panel 68.

As shown in FIG. 1, the right side top exterior corner 138 on the rear panel flap 48 forms a 135-degree angle with the adjacent right side top angled corner edge 126, and the left side top exterior corner 140 forms a 135-degree angle with the adjacent left side top angled corner edge 128. In addition, the right side exterior corner 130 on the front panel 44 forms a 135-degree angle with the adjacent right side angled corner edge 122, and the left side exterior corner 132 on the front panel 44 forms a 135-degree angle with the adjacent left side angled corner edge 124.

In one implementation of the carrier 20, each opening 40 in the plurality of drink cup openings 40 in the top panel 30 includes at least one bendable tab 142 extending from the top panel 30 into the opening 40. As shown, there are four bendable tabs 42 spaced equidistantly around the circumference of the opening 40. The tabs 40 are sized and shaped to frictionally engage the drink cup 22 when the drink cup 22 is inserted into the opening 40.

The right side support flap 84 and the left side support flap 86 on the middle panel 68 each have a cutout 146, 148, respectively, that is formed along the outer edge of the flap 84, 86. These cutouts are sized and shaped to permit the right side tab 100 and left side tab 102 to be inserted past the respective right side support flap 84 and left side support flap 86 after the top panel 30 has been folded over the middle panel 68.

FIGS. 2 and 3 show top plan views of the unfolded eight-cup drink cup carrier 26 and the twelve-cup drink cup carrier 28, respectively. Identical or highly similar features are shown with the same reference numbers used for the four-cup foldable drink cup carrier 20.

Shown in FIGS. 4-6 are the three different carriers 20, 26, 28 in the folded configuration. The steps to fold the carriers 20, 26, 28 into the folded configuration are essentially the same and will be described and illustrated with respect to the eight-cup foldable drink cup carrier 26.

Figure 7:
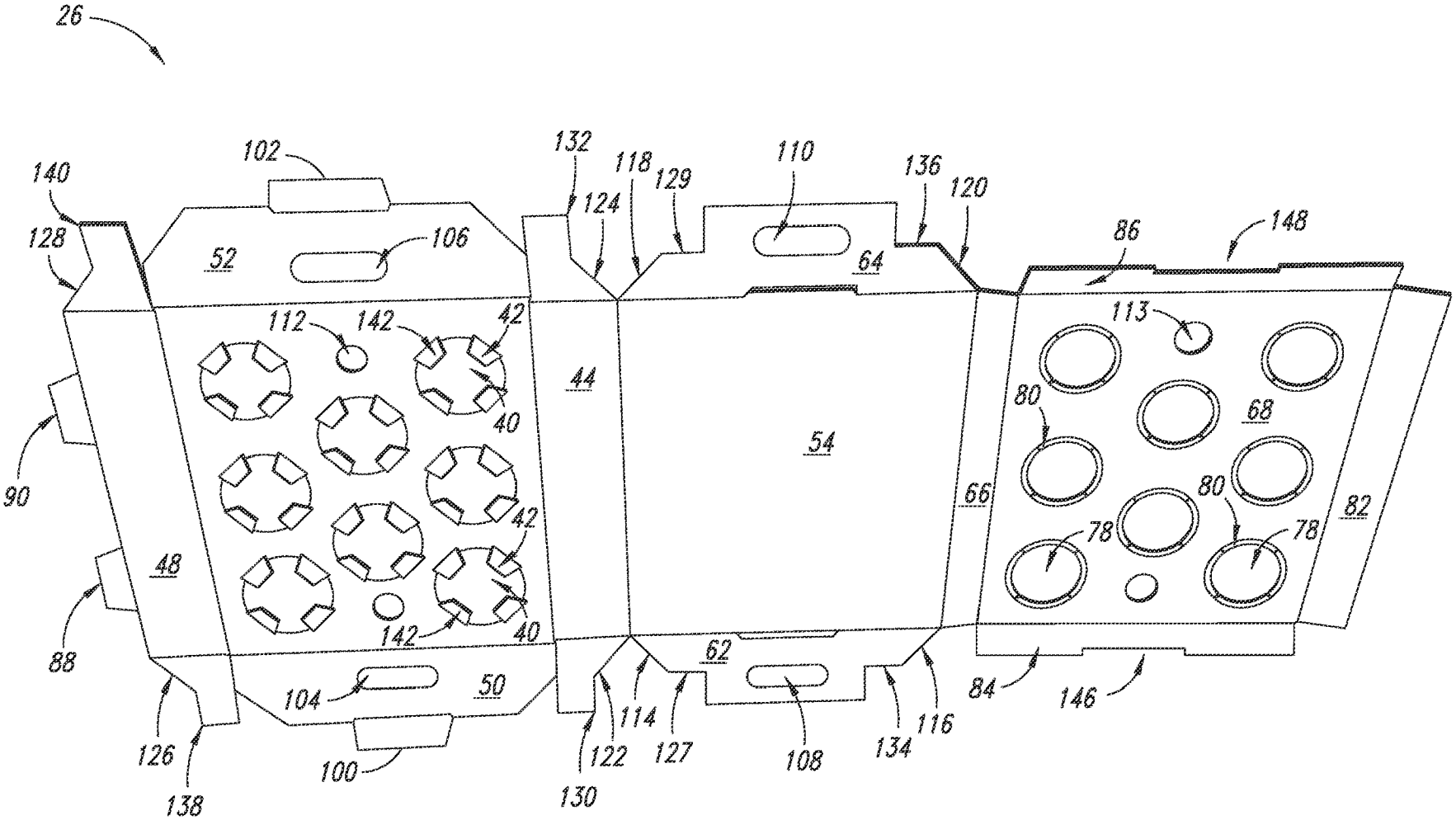
FIG. 7 is a top plan view of the eight-cup foldable drink cup carrier in the unfolded configuration.
Figure 8:
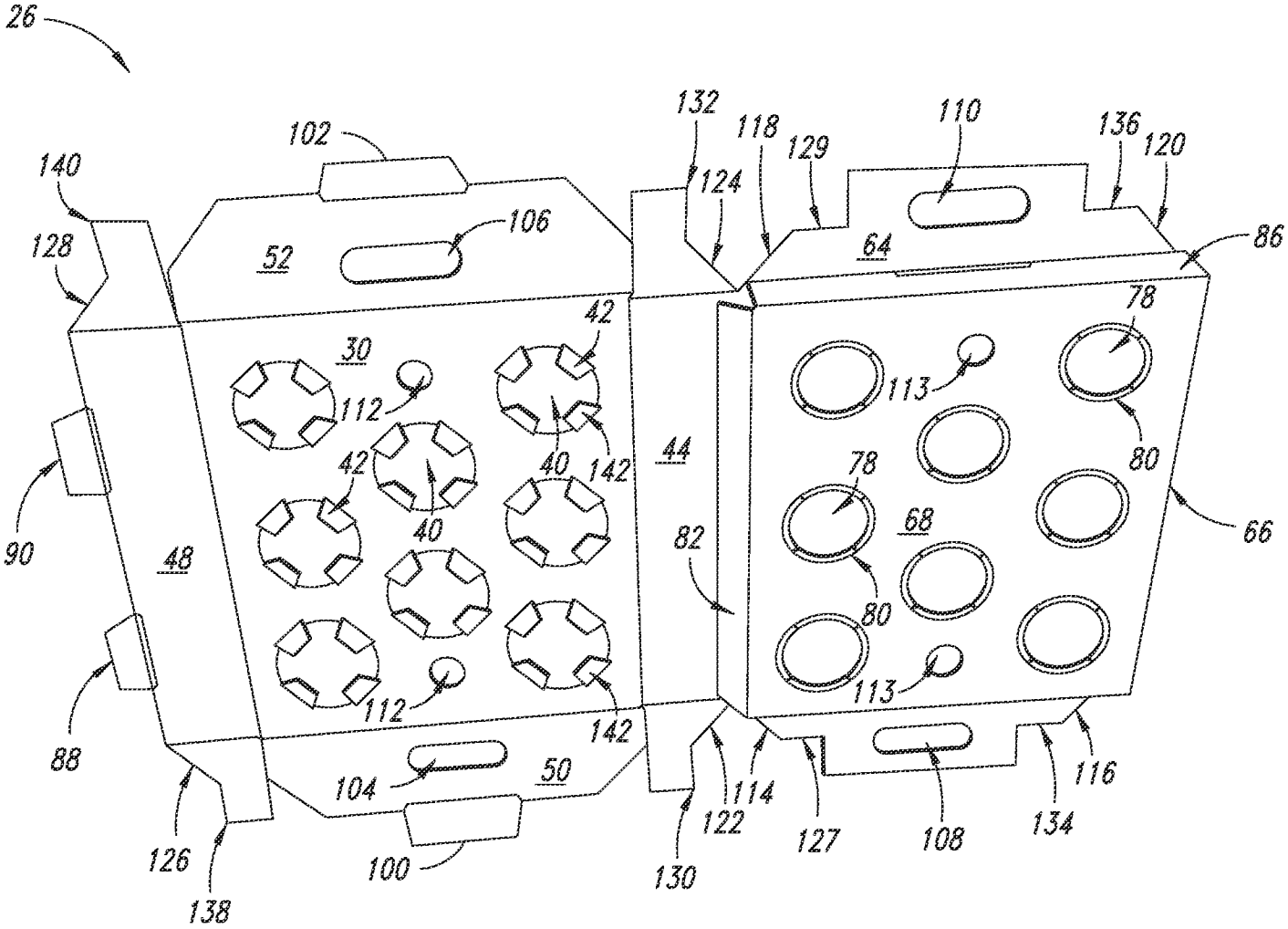
FIG. 8 is an illustration of the middle panel folded over the bottom panel.

As shown in FIG. 7, the carrier 26 is shown in the flattened, unfolded configuration. In FIG. 8, the middle panel 68 is folded at the bend lines to be over the bottom panel 54. The three flaps 82, 84, 86 will support the middle panel 68 on the bottom panel 54 when the flaps 82, 84, 86 are bent at substantially a right angle so the flaps 82, 84, 86 are orthogonal to the middle panel 68 and the bottom panel 54.

Figure 9:
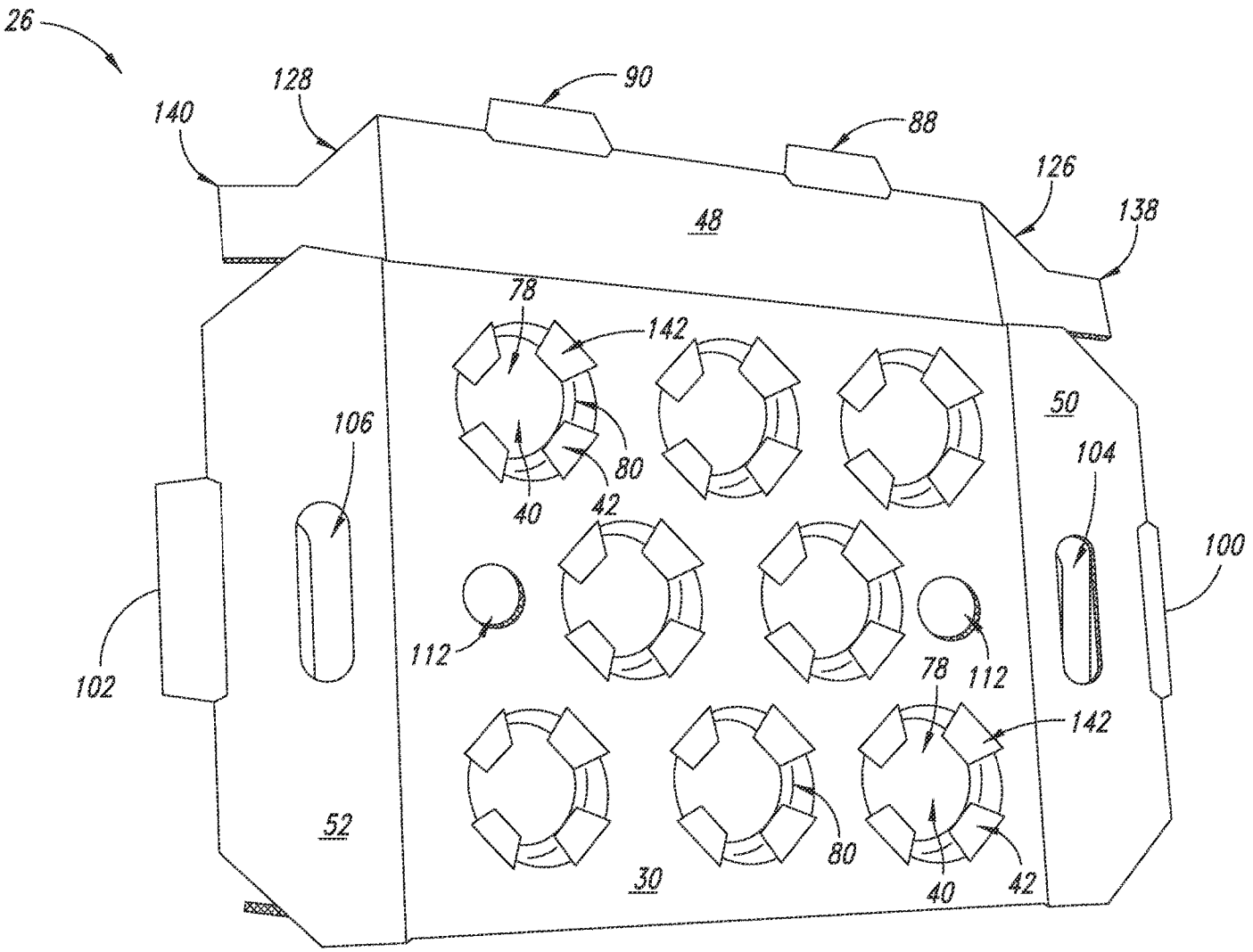
FIG. 9 is an illustration of the top panel folded over the middle panel.

In FIG. 9, the top panel 30 is folded about the bend lines to be positioned over the middle panel 68 so that the drink cup openings 40 in the top panel are in concentric alignment with the openings 78 in the middle panel, as shown.

Figure 10:
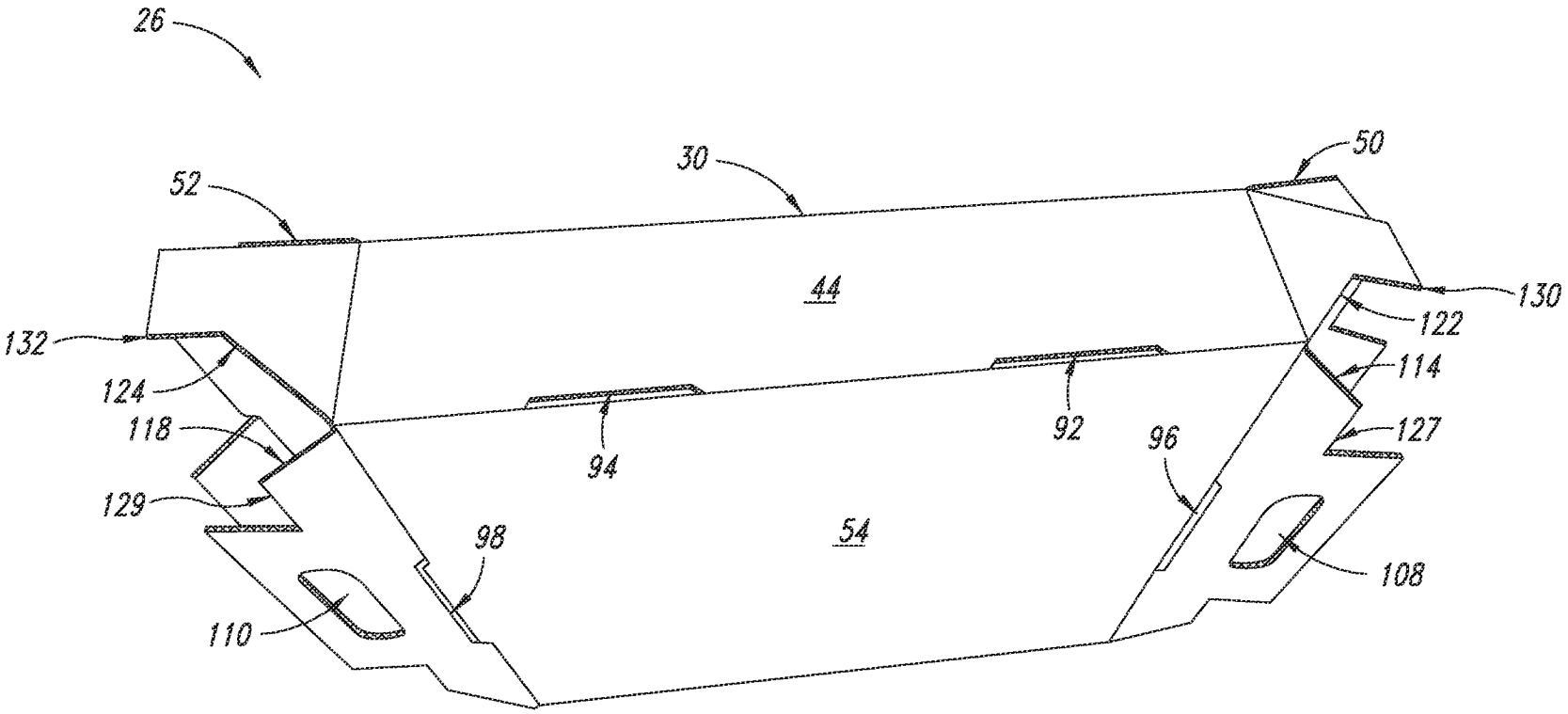
FIG. 10 is an illustration of the side tabs inserted into the slit in the interior flap.
Figure 11:
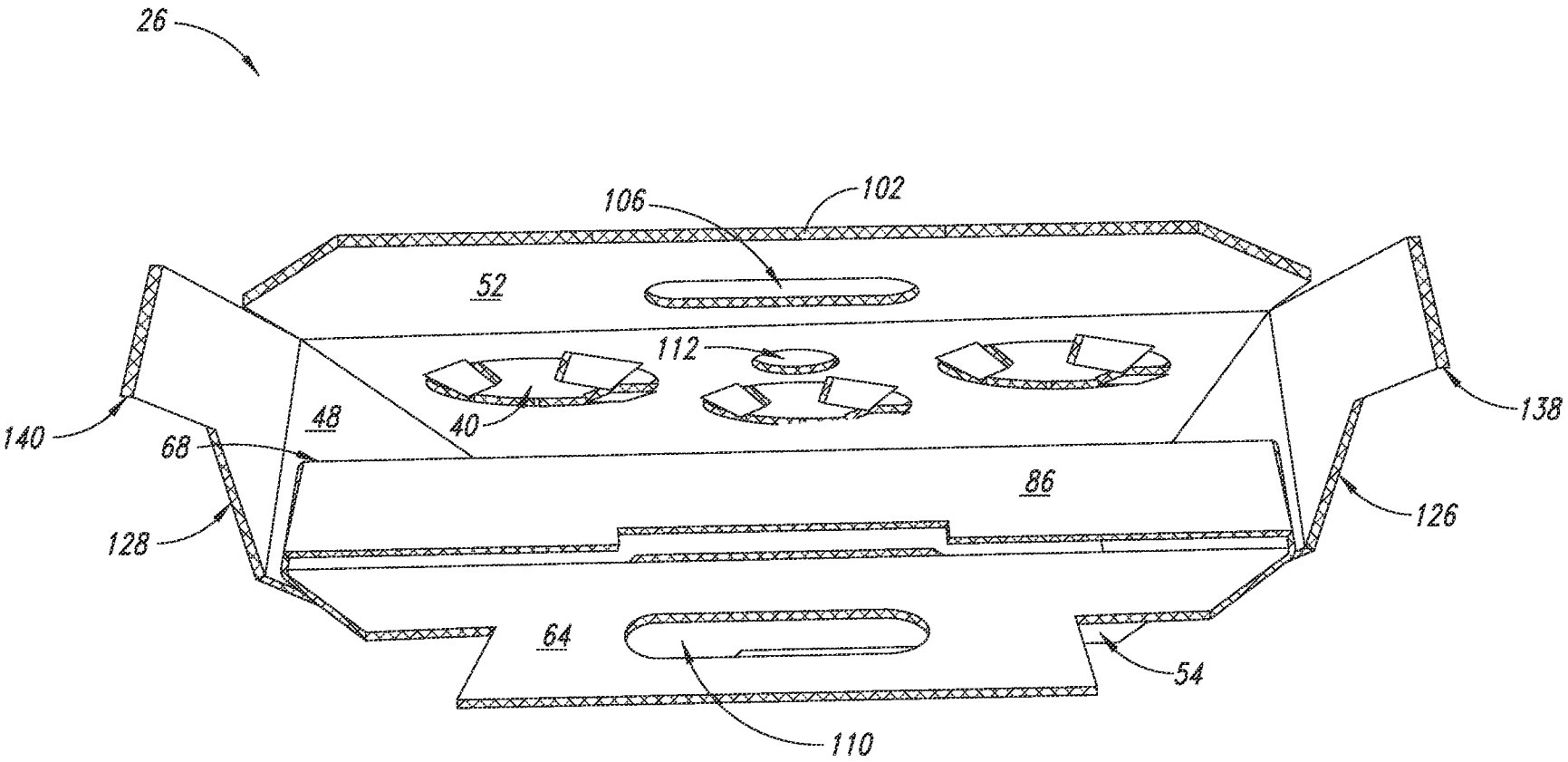
FIG. 11 is an illustration of an open end of the carrier.

In FIG. 10, the rear panel flap 48 is folded about the rear bend line 34 to be orthogonal to the bottom panel 54. The right and left back tabs 88, 90, are inserted into the slits 92, 94, respectively, to hold the top panel 30 in place. The ends of the carrier 20 are open, as shown in FIG. 11, where the middle panel 68 is supported on the bottom panel 54.

Figure 12:
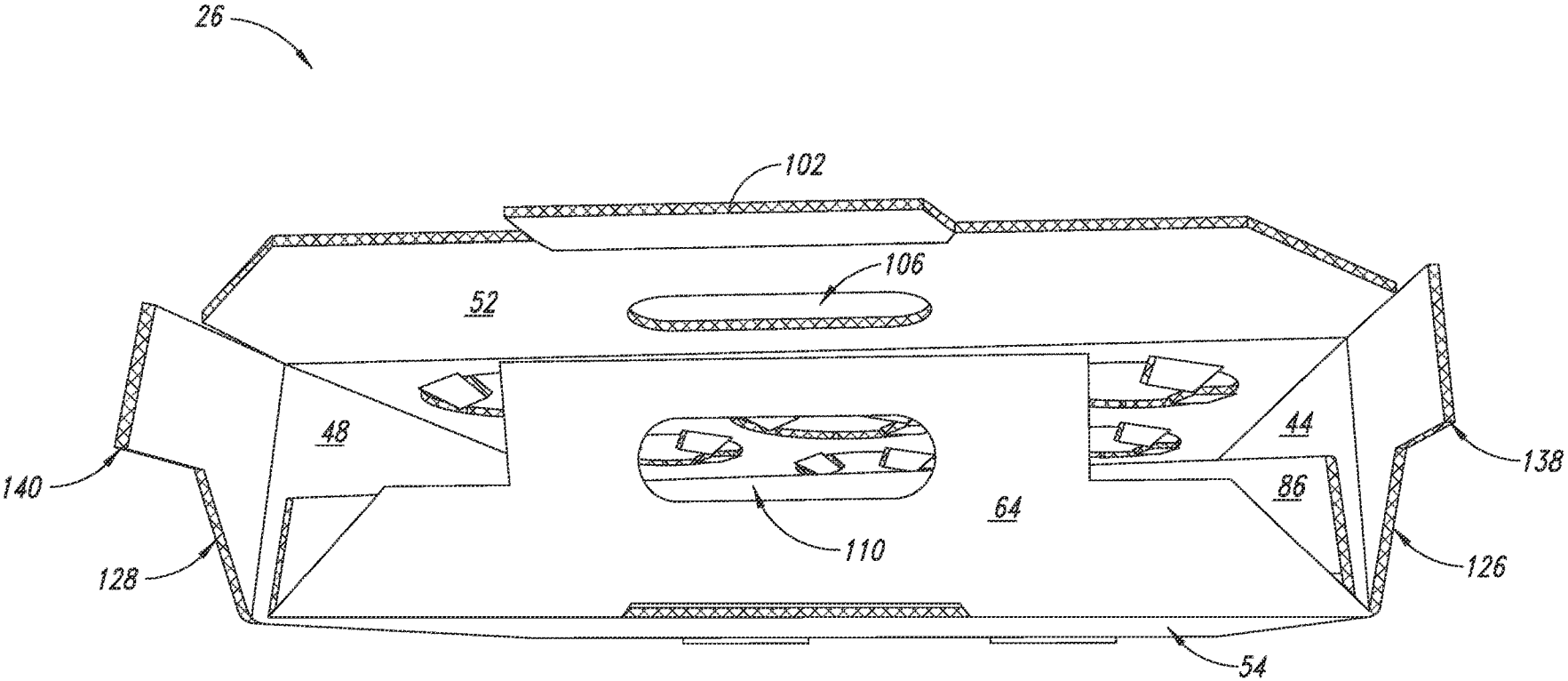
FIG. 12 is an illustration of a first step of partially closing the end of the carrier.
Figure 13:
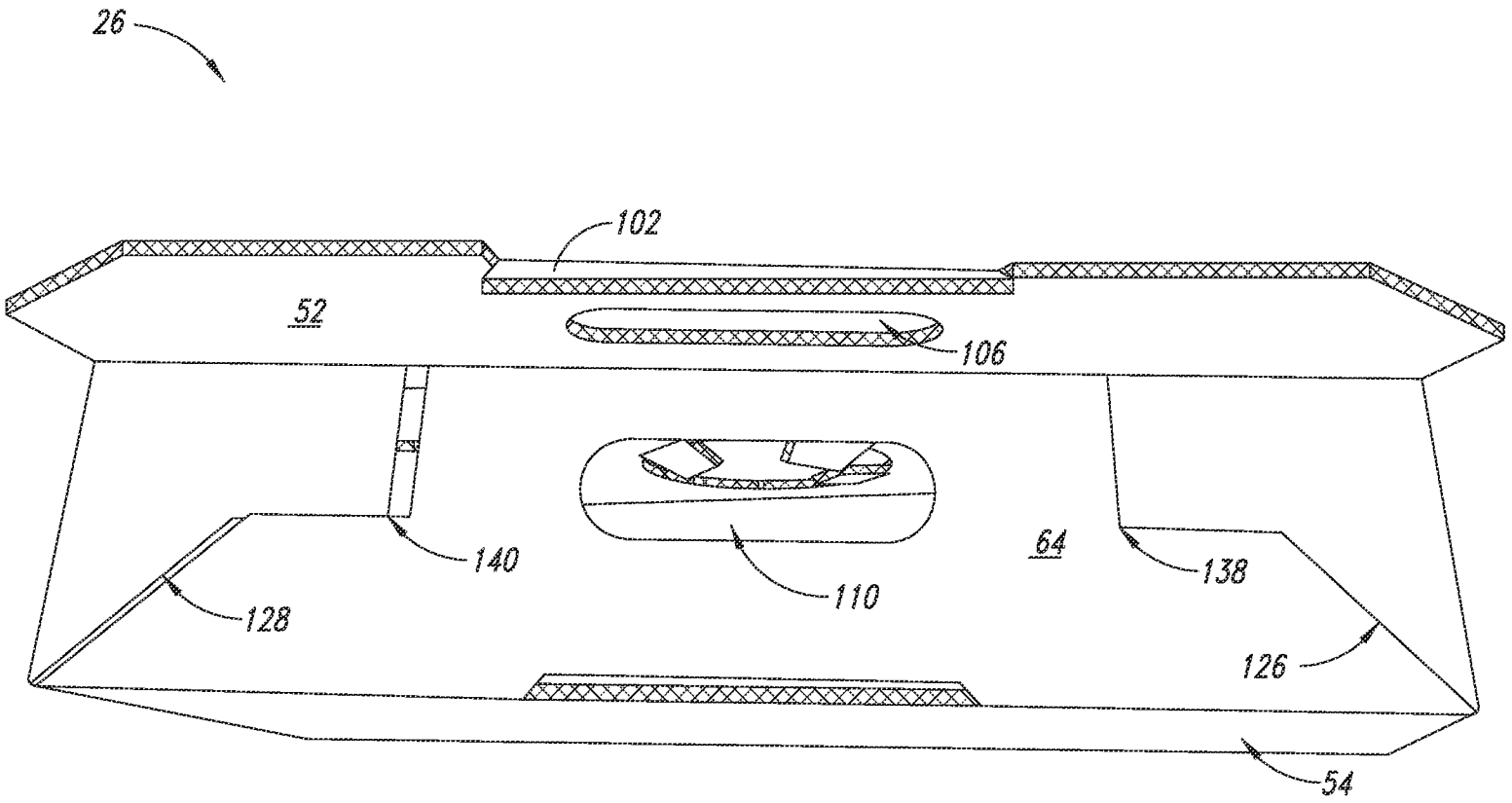
FIG. 13 is an illustration of a second step of partially closing the end of the carrier.
Figure 14:
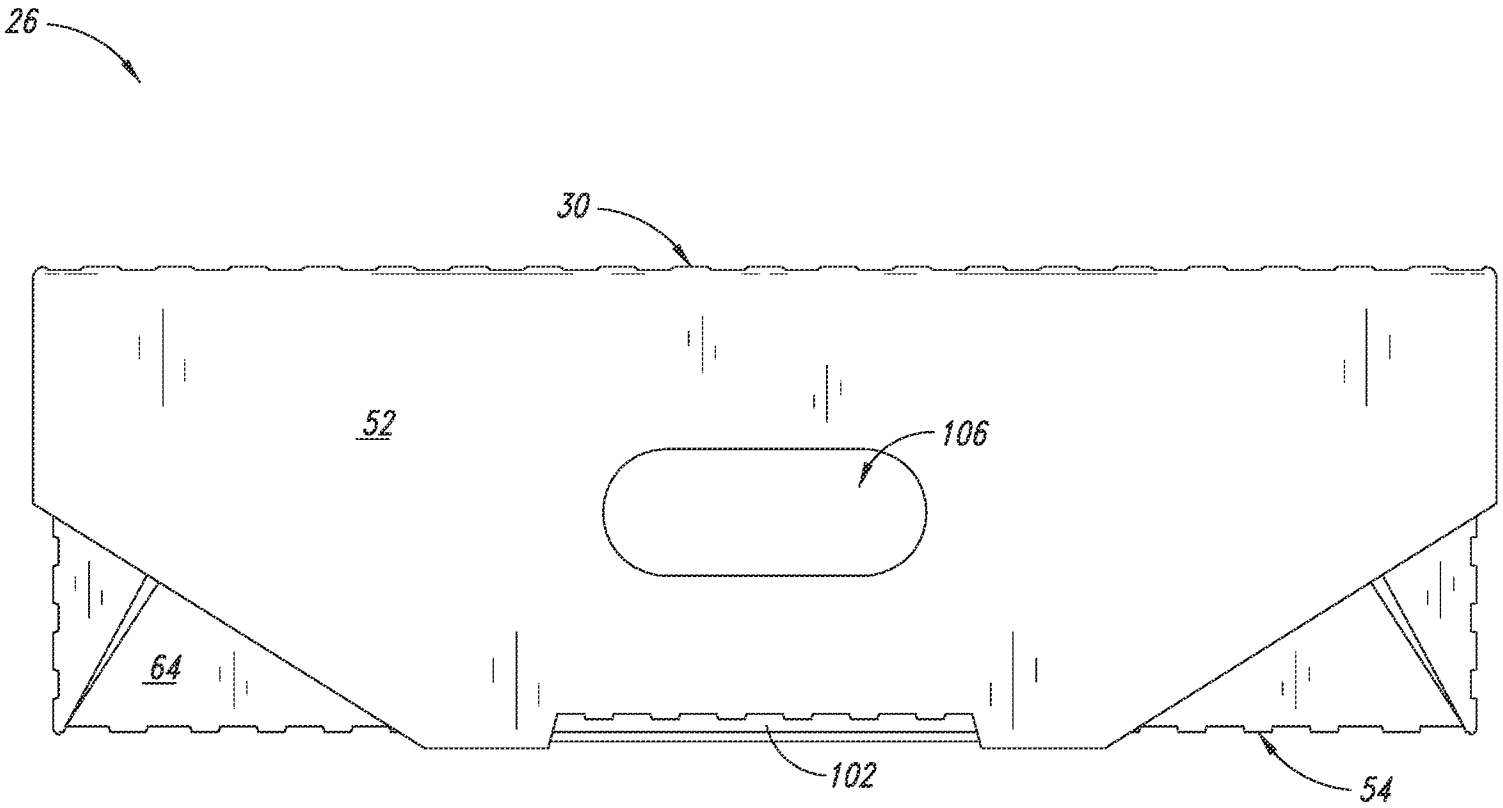
FIG. 14 is an illustration of a final step of closing the end of the carrier.

Next, the left side interior flap 64 is folded over to be orthogonal to the bottom panel 54 as shown in FIG. 12. The right and left sides of the front panel 44 and rear panel flap 48 are then folded over so the left side top angled corner edge 128 butts against the left side angled corner edge 120, and the right side top angled corner edge 126 butts against the right side rear angled corner edge 116, which is shown in FIG. 13. In addition, the right side top exterior corner 138 nests inside the right side rear interior corner 134, while the left side top exterior corner 140 nests inside the left side rear internal corner 136, again as shown in FIG. 13. The left side exterior flap 52 is then folded over to be orthogonal to the top panel 30 and bottom panel 54 and secured in place by sliding the left side tab 102 into the slit 98, as shown in FIG. 14.

The opposite end of the carrier 20 is folded and secured in the same fashion to achieve the folded configuration of the eight-cup foldable drink cup carrier 26 shown in FIG. 5. These same steps apply to the four-cup carrier 20 and twelve-cup carrier 28.

Figure 15:
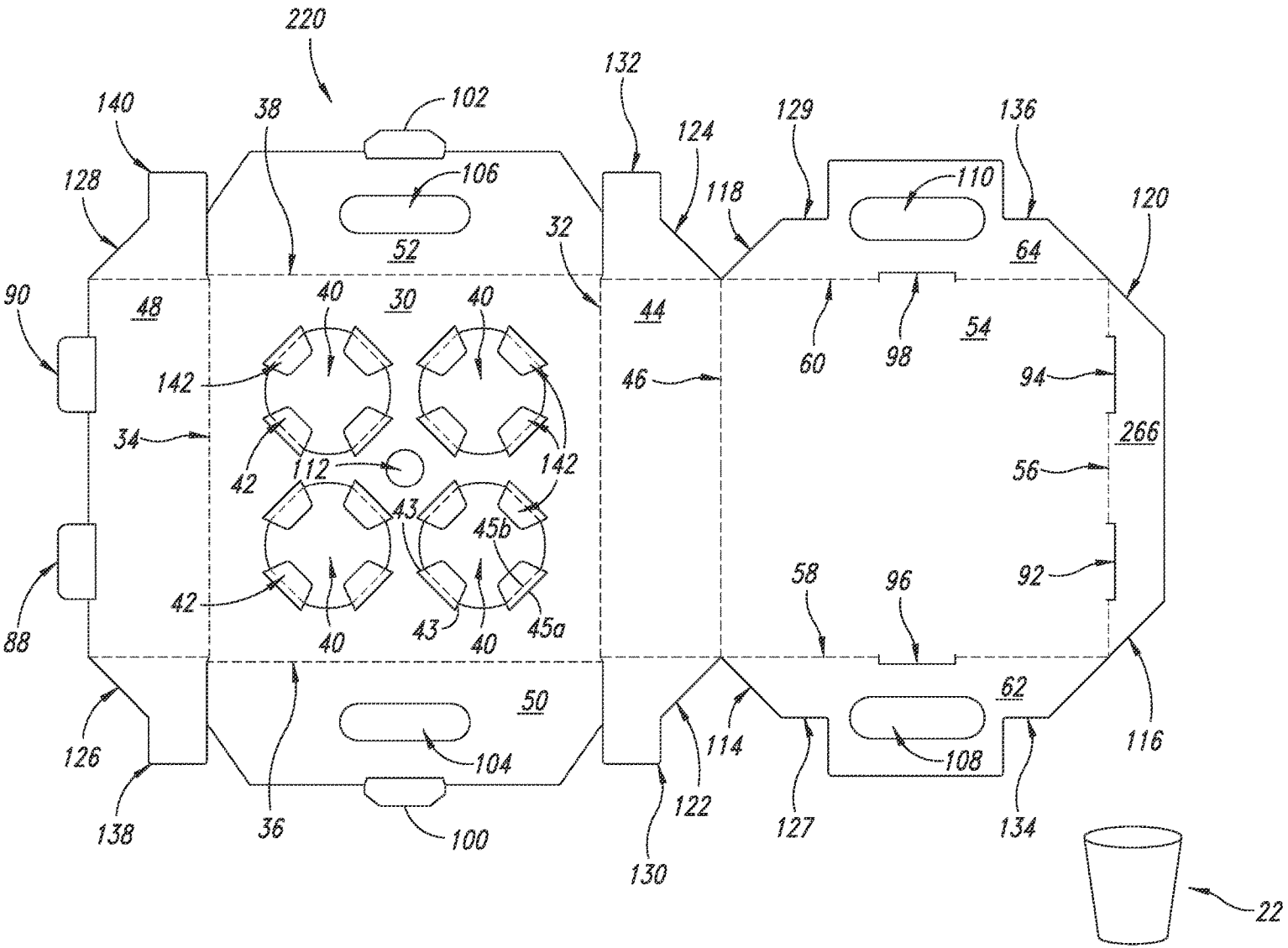
FIGS. 15-17 are top plan views of four-cup, eight-cup, and twelve-cup foldable beverage cup carriers, respectively, shown in an unfolded, flattened configuration without a middle panel in accordance with another implementation of the present disclosure.
Figure 16:
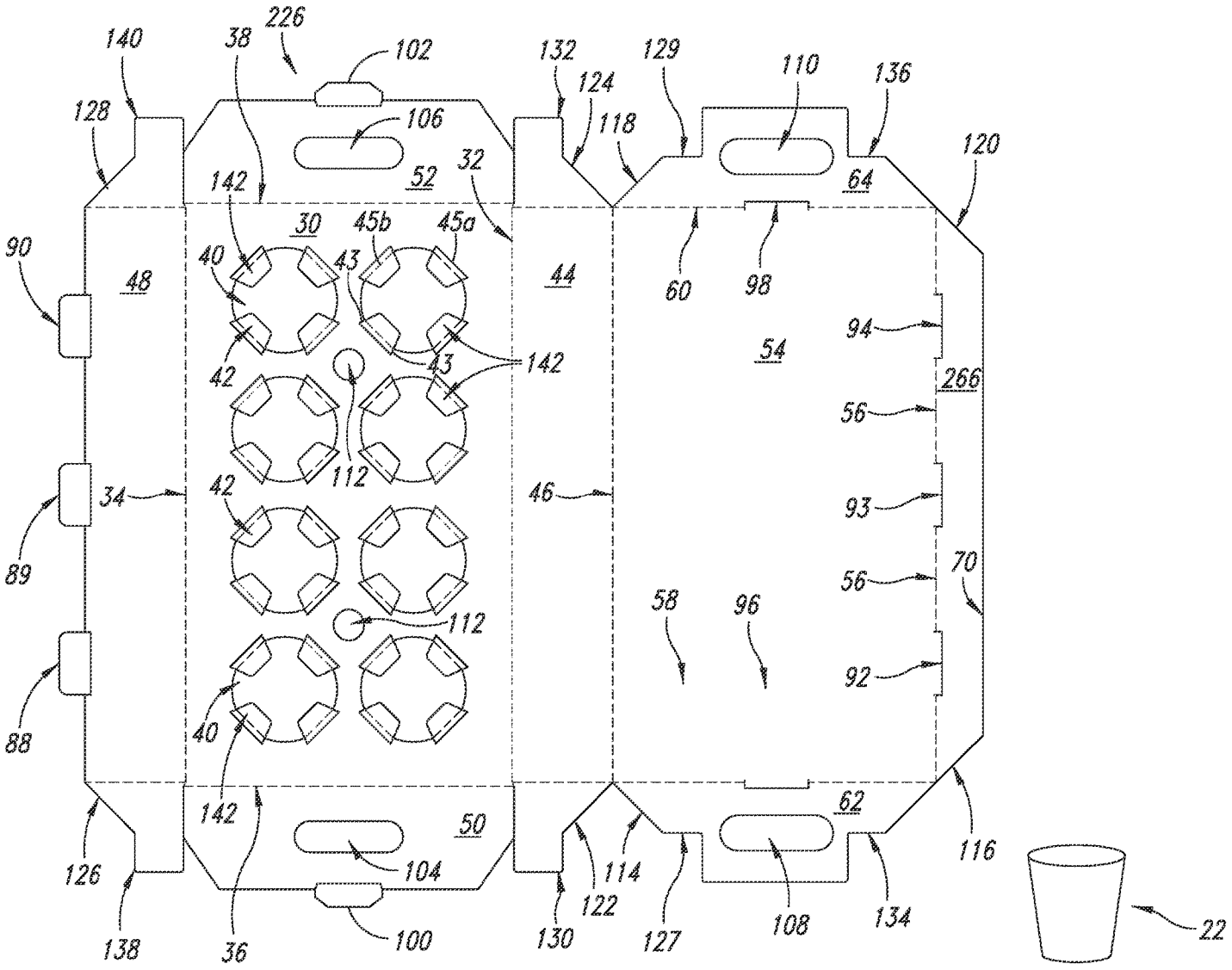
Figure 17:
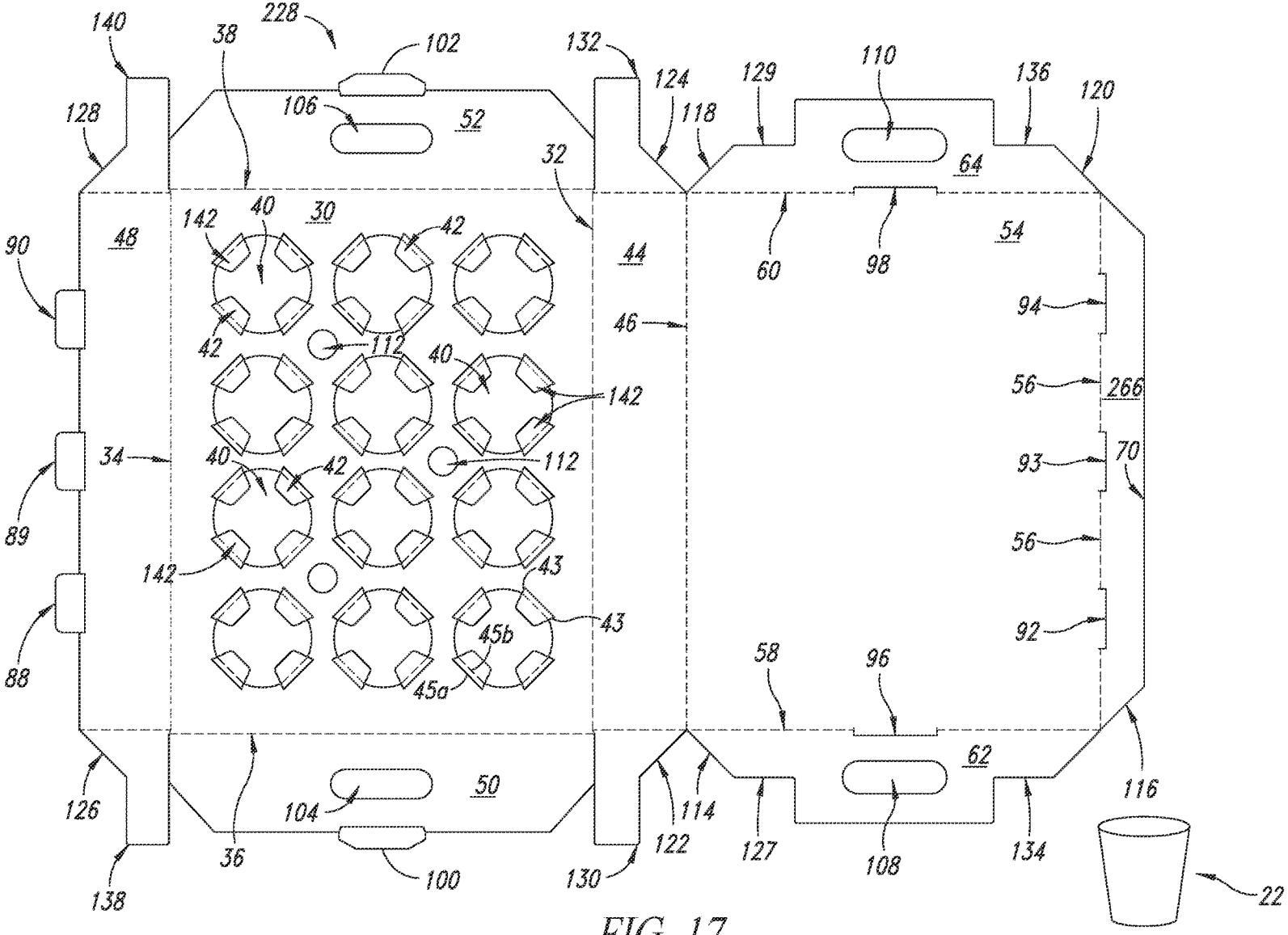

FIG. 15 shows a flattened foldable carrier 220 that is designed to hold up to four drink cups 22 and four straws (not shown). Unlike the previously described foldable drink cup carriers 20, 26, 28, this carrier 220 does not have a middle panel 68. FIGS. 16 and 17 show an eight-cup flattened foldable carrier 226 and the twelve-cup flattened foldable carrier 228, respectively, both of which likewise do not have a middle panel 68. These two-panel carriers 220, 226, 228 nevertheless contain many identical features as the three-panel carriers 20, 26, 28 and, for ease of reference, are shown with the same reference numbers used with the three-panel carriers 20, 26, 28.

Figure 18:
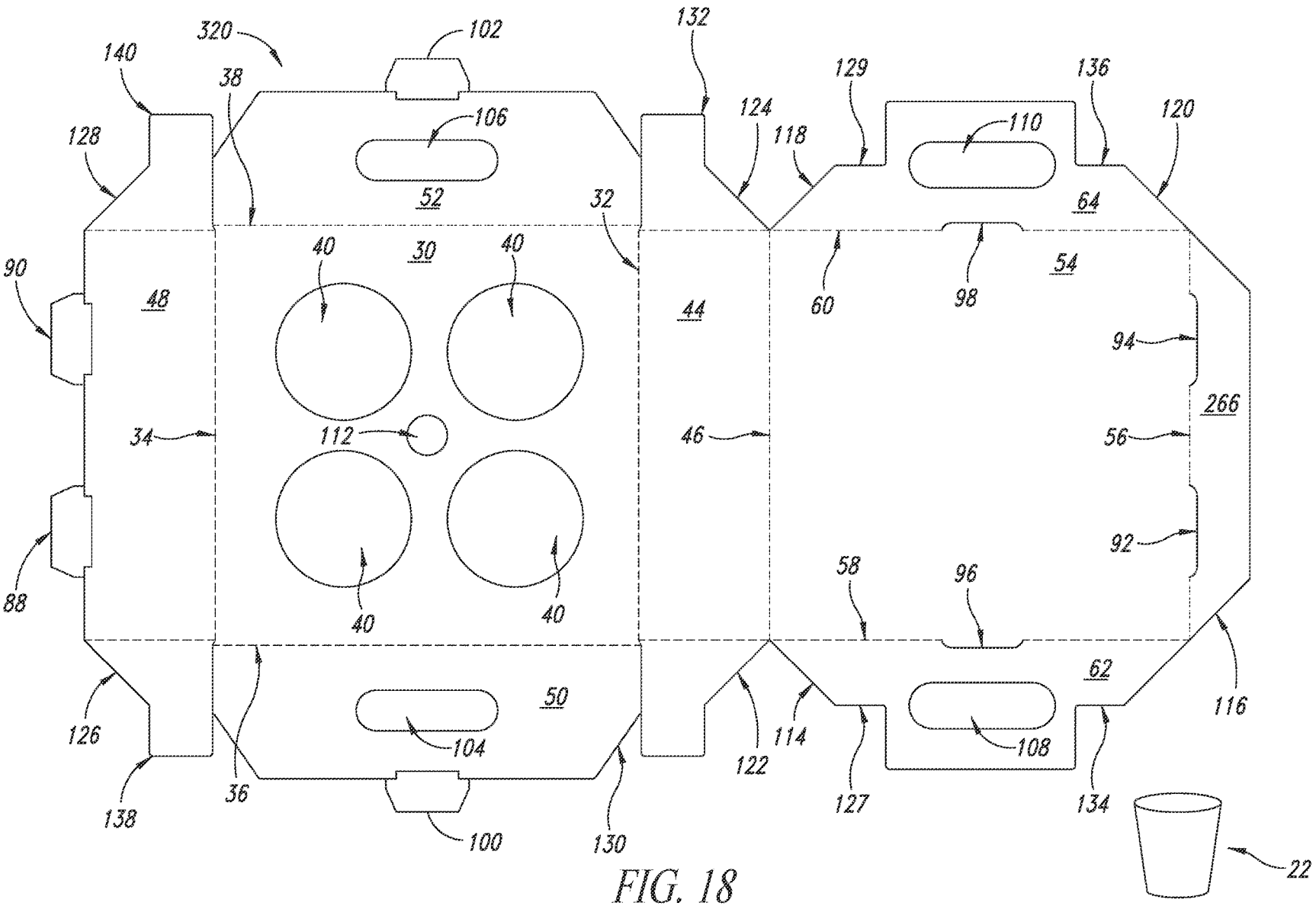
FIGS. 18-20 are top plan views of four-cup, eight-cup, and twelve-cup foldable beverage cup carriers, respectively, shown in an unfolded, flattened configuration without a middle panel and without tabs extending from the top panel into the drink cup openings in accordance with another implementation of the present disclosure.
Figure 19:
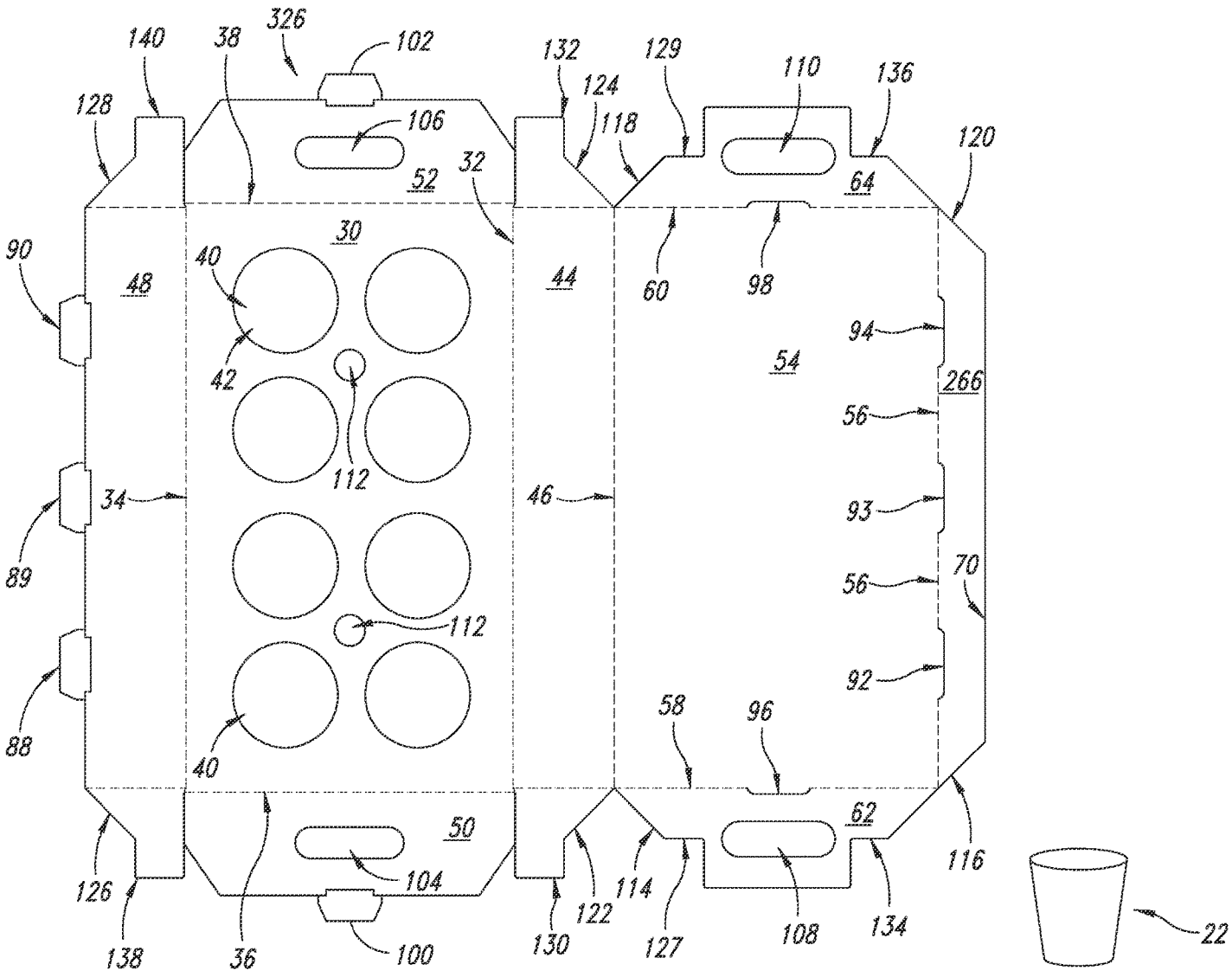
Figure 20:
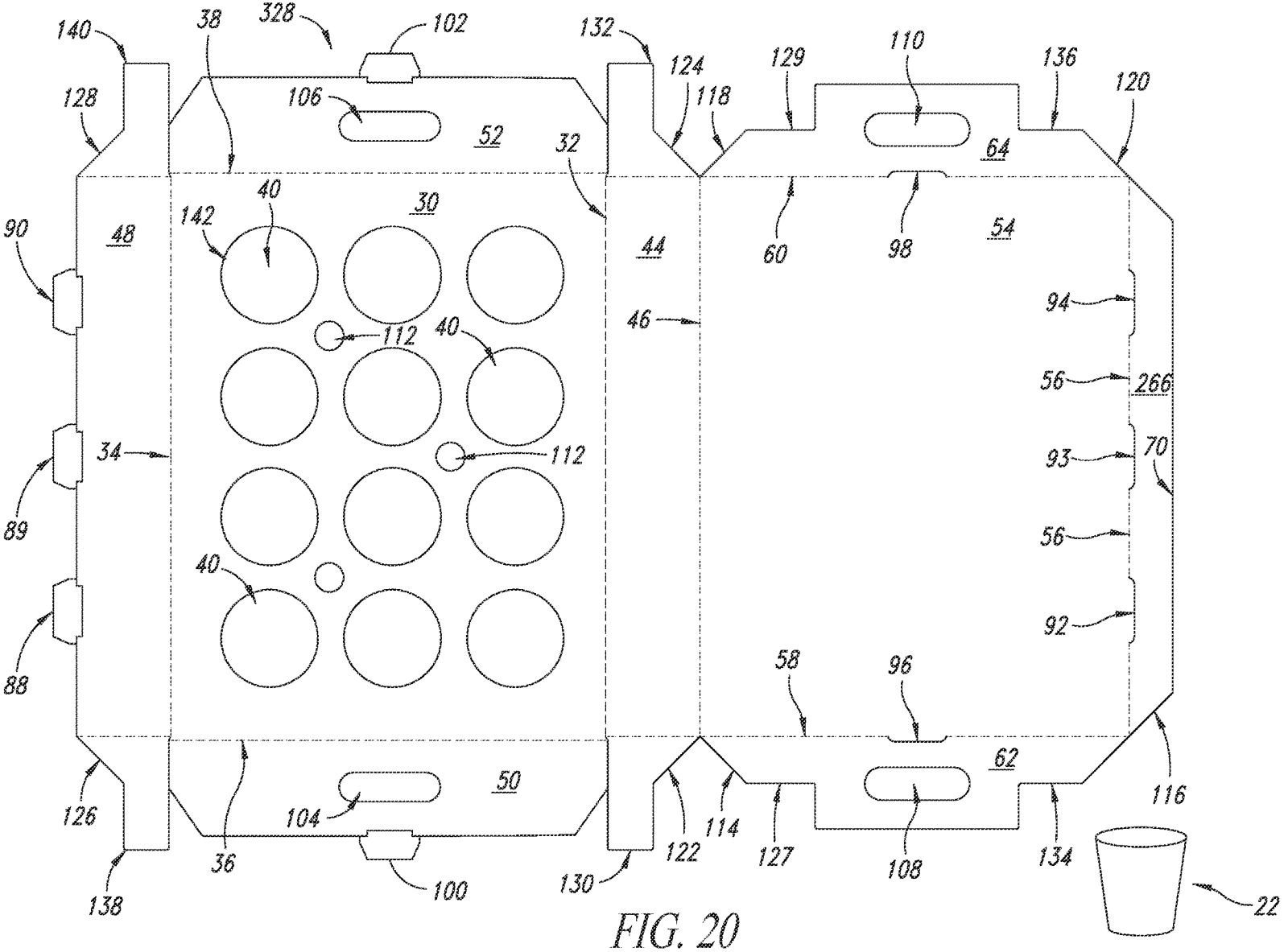
Figure 21:
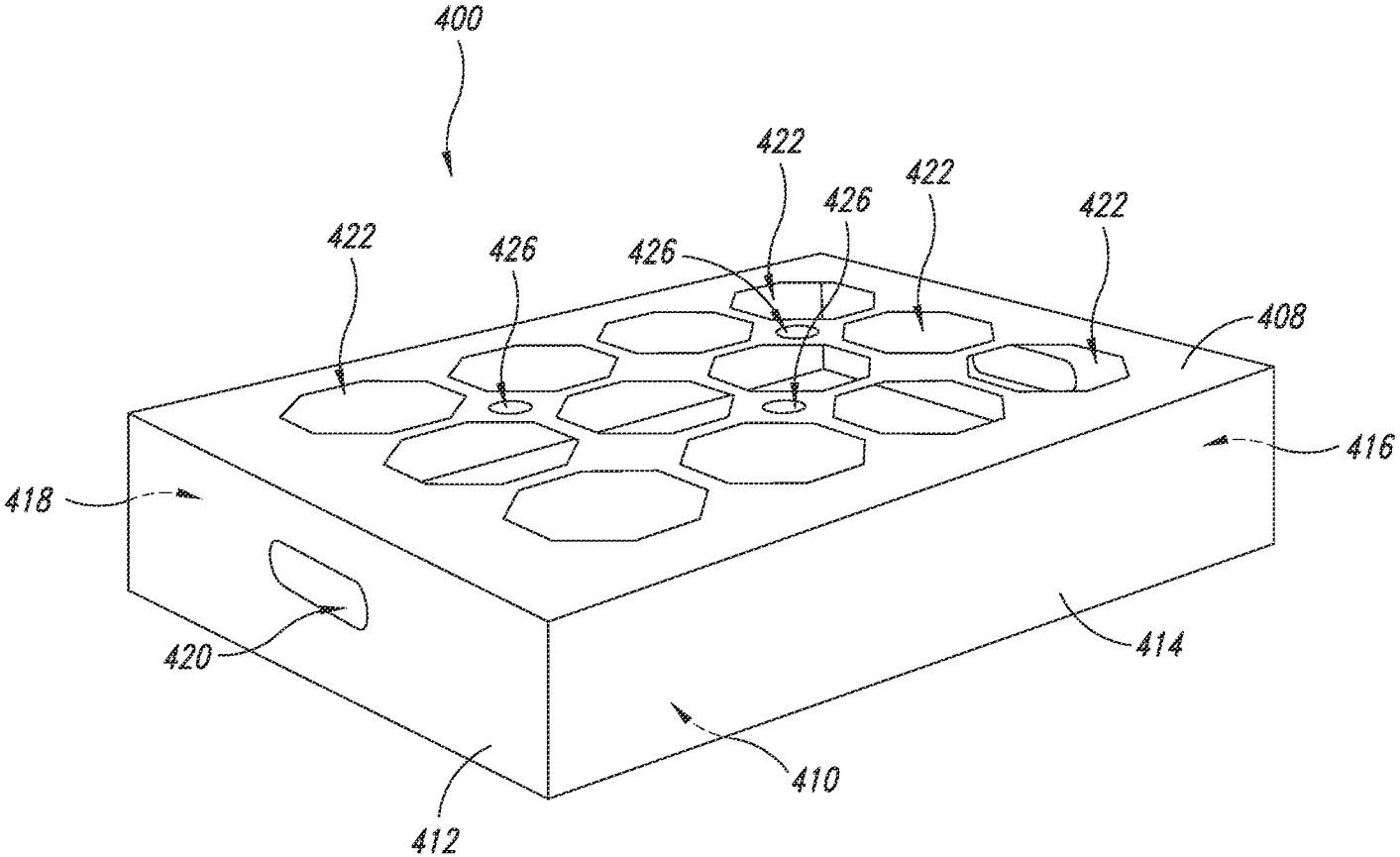
FIG. 21 is an axonometric illustration of a non-foldable twelve-cup drink cup carrier formed in accordance with another implementation of the present disclosure.
Figure 22:
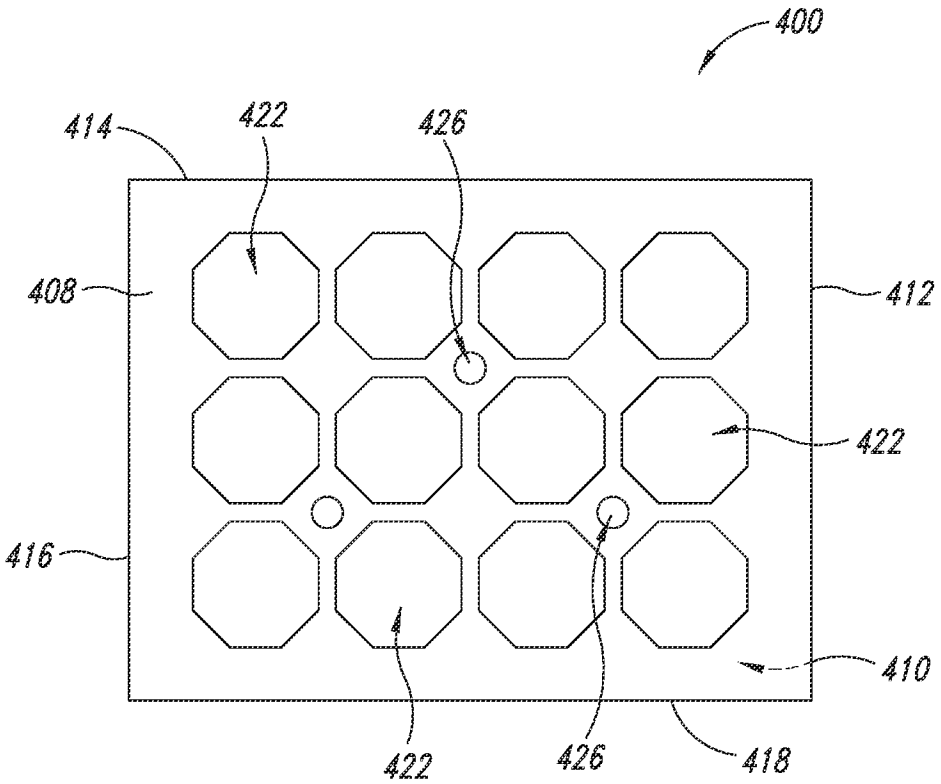
FIG. 22 is a top plan view of the drink cup carrier of FIG. 21.
Figure 23:
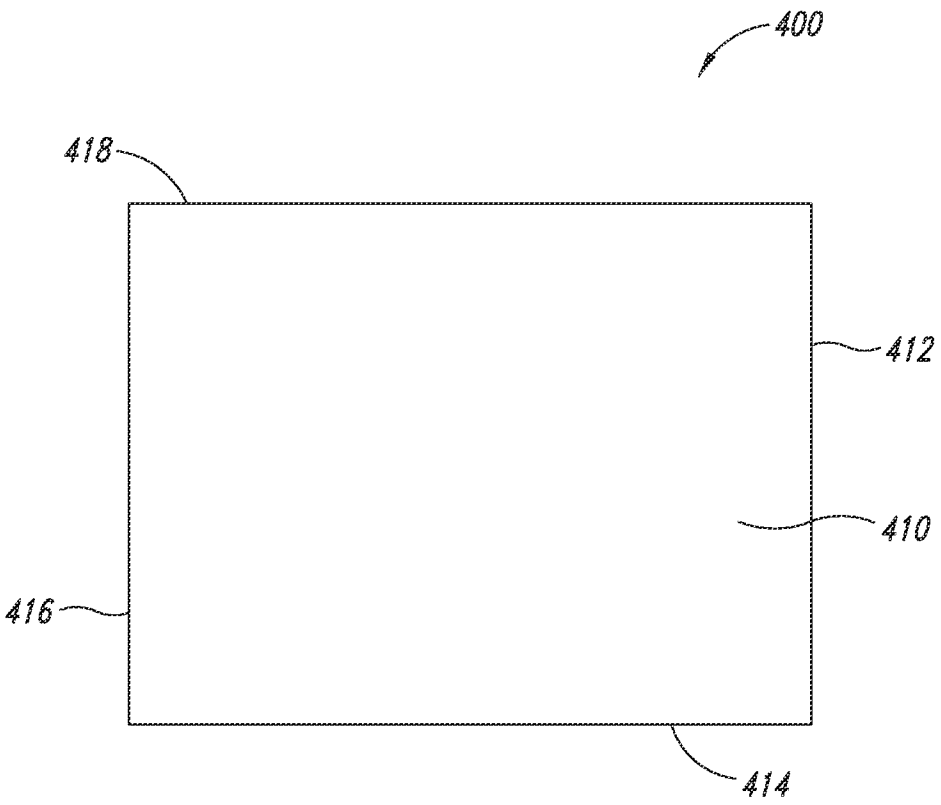
FIG. 23 is a bottom plan view of the drink cup carrier of FIG. 21.
Figure 24:
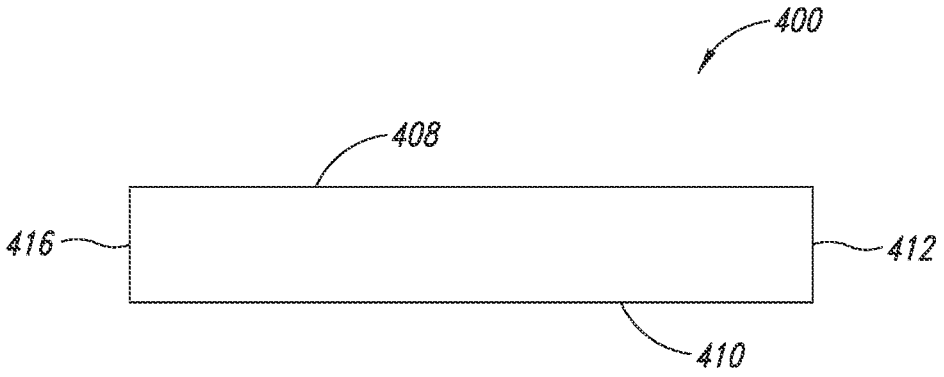
FIG. 24 is a front side elevational view of the drink cup carrier of FIG. 21, the rear side being a mirror image thereof.
Figure 25:
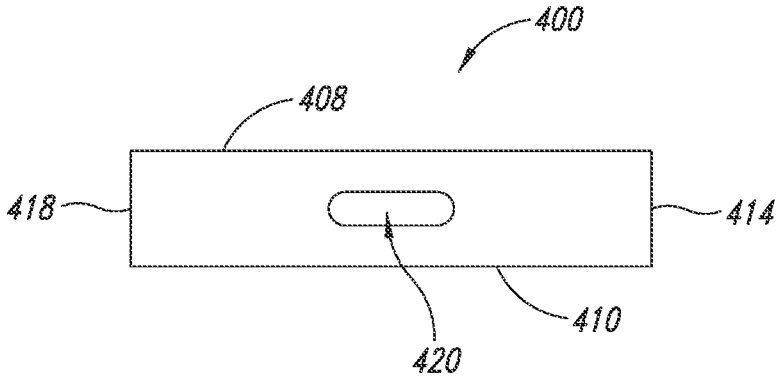
FIG. 25 is a right side elevational view of the drink cup carrier of FIG. 21, the left side being a mirror image thereof.
Figure 26:
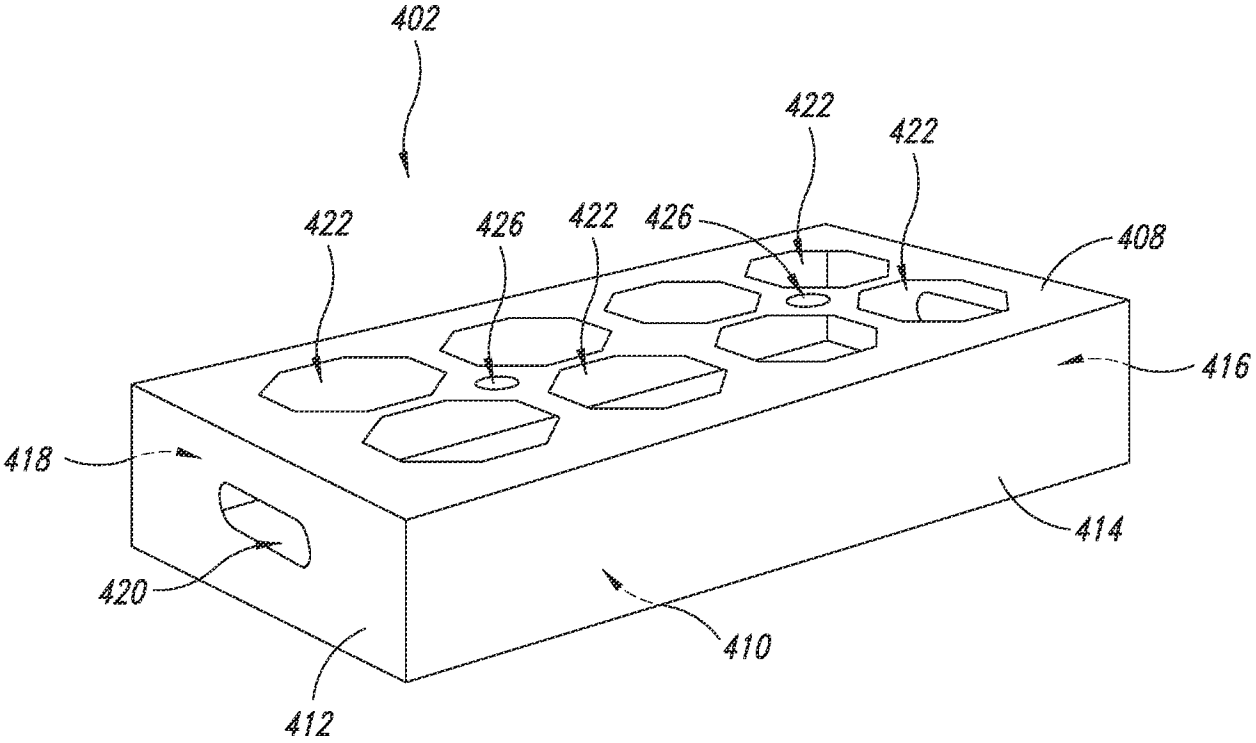
FIG. 26 is an axonometric illustration of a non-foldable eight-cup drink cup carrier formed in accordance with another implementation of the present disclosure.
Figure 27:
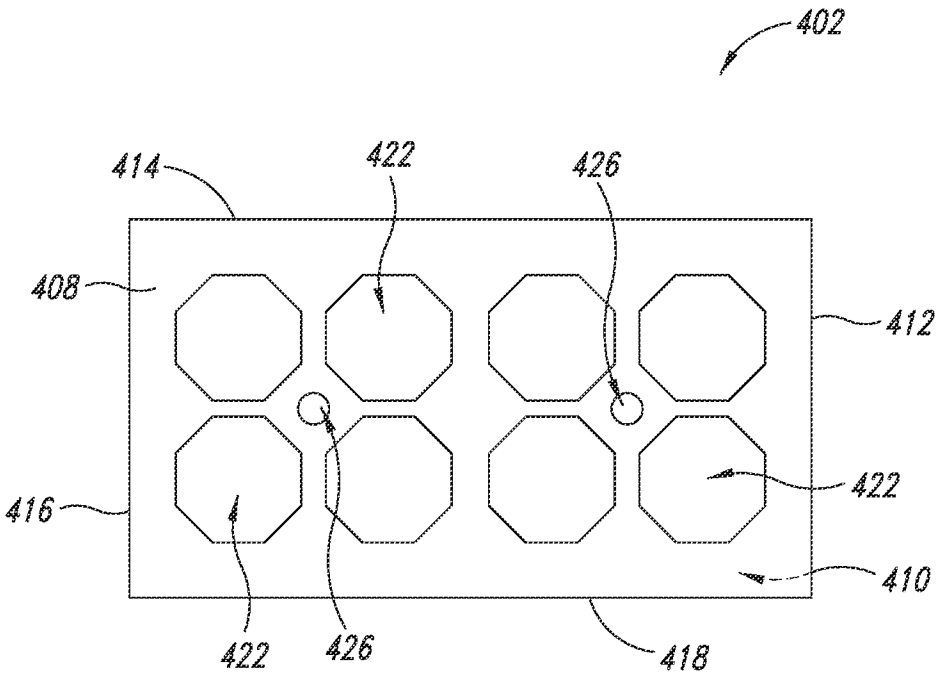
FIG. 27 is a top plan view of the drink cup carrier of FIG. 26.
Figure 28:
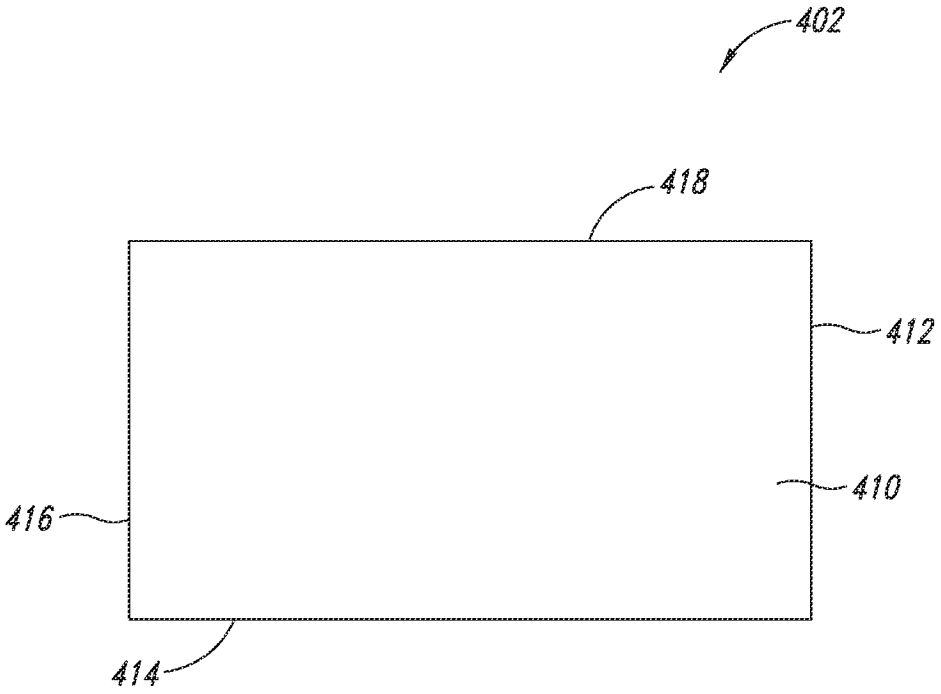
FIG. 28 is a bottom plan view of the drink cup carrier of FIG. 26.
Figure 29:
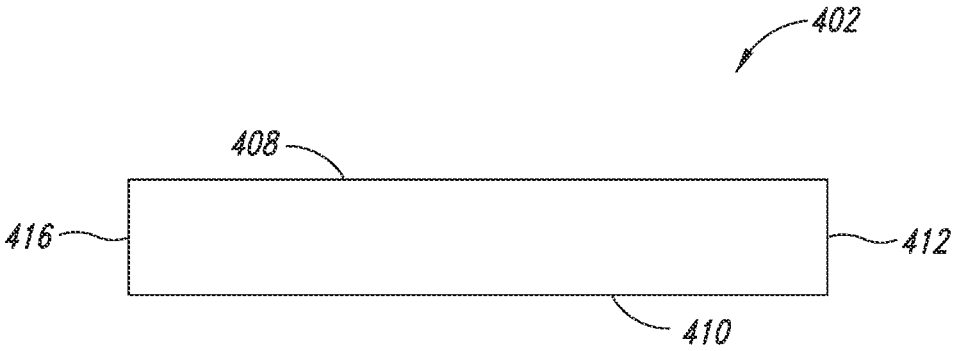
FIG. 29 is a front side elevational view of the drink cup carrier of FIG. 26, the rear side being a mirror image thereof.
Figure 30:
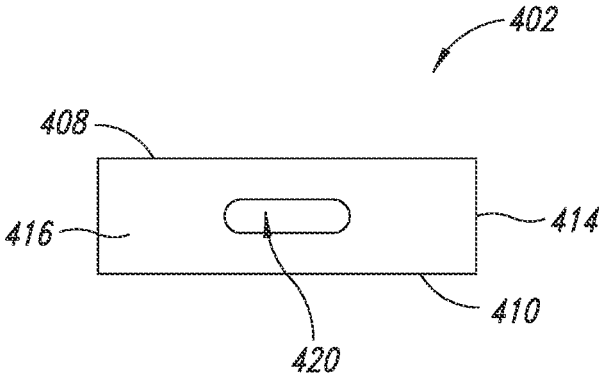
FIG. 30 is a right side elevational view of the drink cup carrier of FIG. 26, the left side being a mirror image thereof.
Figure 31:
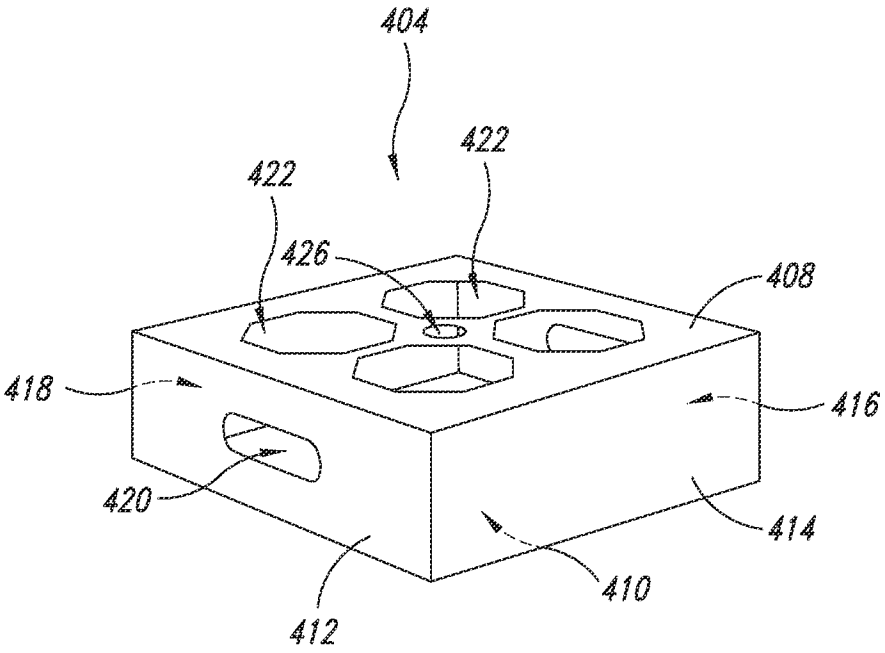
FIG. 31 is an axonometric illustration of a non-foldable four-cup drink cup carrier formed in accordance with another implementation of the present disclosure.
Figure 32:
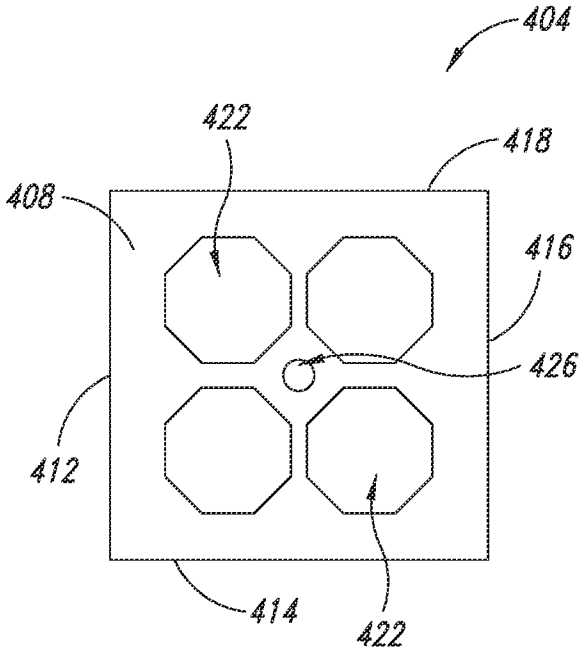
FIG. 32 is a top plan view of the drink cup carrier of FIG. 31.
Figure 33:
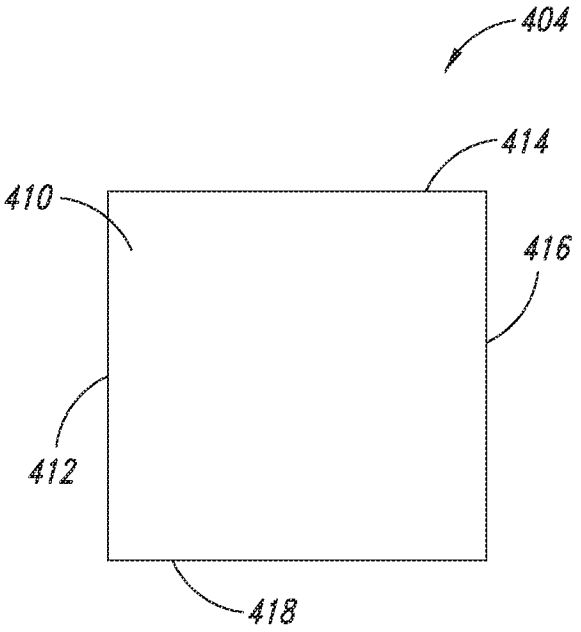
FIG. 33 is a bottom plan view of the drink cup carrier of FIG. 31.
Figure 34:
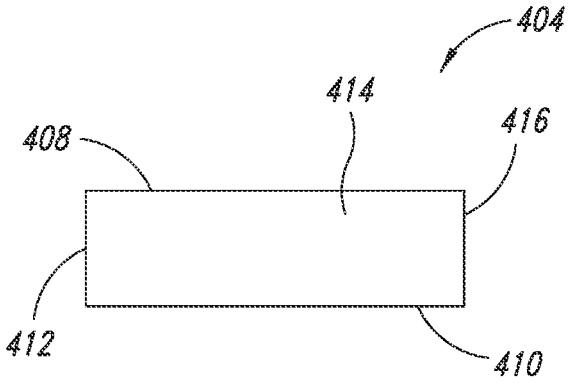
FIG. 34 is a front elevational view of the drink cup carrier of FIG. 31, the rear side being a mirror image thereof.
Figure 35:
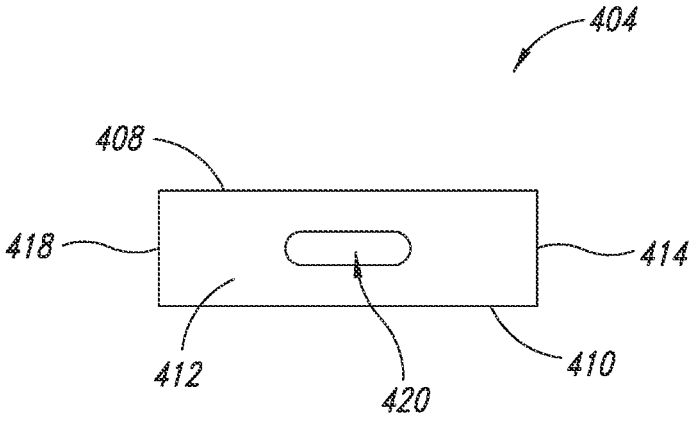
FIG. 35 is a right side elevational view of the drink cup carrier of FIG. 31, the left side being a mirror image thereof.

FIG. 18 shows a flattened foldable carrier 320 identical to the four-cup carrier 220 except that the carrier 320 does not have tabs 42 projecting inward from the top panel 30 into the cup openings 40. FIG. 19 shows an eight-cup flattened foldable carrier 326, and FIG. 20 shows a twelve-cup flattened foldable carrier 328. Both of these carriers 326, 328 likewise do not have the tabs 42; in other words, they are identical to the four-cup and eight-cup two-panel carriers 226, 228, respectively, except they do not have the tabs 42. These three tab-less, two-panel carriers 320, 326, 328 nevertheless contain many nearly identical features with the previously described carriers 20, 26, 28, 220, 226, 228 and are shown in FIGS. 18-20 with the same reference numbers used for the similar features.

More particularly, FIG. 15 shows that the four-cup two-panel carrier 220 includes a rear support panel 266 extending from the bottom rear bend line 56 on the bottom panel 54. FIGS. 16-20 show that the other two-panel carriers 226, 228, 320, 326, and 328 also include the rear support panel 266. The four-cup two-panel carrier 220 further includes a right back tab 88 extending from the rear panel flap and a left back tab 90 extending from the rear panel flap sized and shaped to be slidably received in the right back tab slit 92 and the left back tab slit 94. The other two-panel carriers 226, 228, 320, 326, and 328 also include the right back tab 88, left back tab 90, right back tab slit 92, and left back tab slit 94.

FIG. 16 shows the eight-cup two-panel carrier 226 additionally includes a middle back tab slit 93 formed in the bottom rear bend line 56, positioned in between the right back tab slit 92 and the left back tab slit 94. The carrier 226 further includes a middle back tab 89 that is positioned between the right back tab 88 and the left back tab 90 and that is sized and shaped to be slidably received by the middle back tab slit 93. The twelve-cup two-panel carrier 228, eight-cup tab-less two-panel carrier 326, and twelve-cup tab-less two-panel carrier 328 also include the middle back tab slit 93 and middle back tab 89.

In use, the steps to fold the two-panel carriers 220, 226, 228, 320, 326, 328 are essentially the same and will be described with respect to the four-cup two-panel drink cup carrier 220. The following steps are only modified for the eight-cup two-panel carrier 226, the twelve-cup two-panel carrier 228, the eight-cup tab-less two-panel carrier 326, and the twelve-cup tab-less two-panel carrier 328 to the extent that for those carriers the middle back tabs 89 and middle back tab slits 93 follow the same steps as the right back tab 88, left back tab 90, right back tab slit 92, and left back tab slit 94.

As shown in FIG. 15, the four-cup two-panel carrier 220 is shown in the flattened, unfolded configuration. The top panel 30 folds at the front bend line 32 to be folded over and located above the bottom panel 54. The rear panel flap 48 is folded about the rear bend line 34 to be orthogonal to the bottom panel 54. The right and back tabs 88, 90 are inserted into the slits 92, 94, respectively, to hold the top panel 30 in place.

Next, the left side interior flap 64 is folded over about 90 degrees to be orthogonal to the bottom panel 54. The left and right sides of the front panel 44 and rear panel flap 48 are then folded over so the left side top angled corner edge 128 butts against the left side angled corner edge 120, and the right side top angled corner edge 126 butts against the right side rear angled corner edge 116. In addition, the right side top exterior corner 138 nests inside the right side rear interior corner 134, while the left side top exterior corner 140 nests inside the left side rear internal corner 136. The left side exterior flap 52 is then folded over to be orthogonal to the top panel 30 and bottom panel 54 and secured in place by sliding the left side tab 102 into the slit 98.

The opposite end of the carrier 220 is folded and secured in the same fashion. These same steps apply to the other two-panel carriers 226, 228, 320, 326, 328. When so assembled, each of the carriers described above form a right rectangular prism. It will be appreciated that the interlocking of the tabs with the slits will form a connection that maintains the carriers described herein in the desired right rectangular shape. This forms a stable platform for receiving liquid-filled drink cups, allowing the carriers to be manually held and carried.

In accordance with another aspect of the present disclosure, a unitary non-foldable drink cup carrier that implements novel features from the foregoing foldable carriers is described herein.

FIGS. 21-25 show the seven standard views of a non-foldable twelve-cup carrier 400, while FIGS. 26-30 illustrate a non-foldable eight-cup carrier 402, and FIGS. 31-35 illustrate a non-foldable four-cup carrier 404. Each of the non-foldable carriers 400, 402, 404 is in the shape of a right rectangular prism with a hollow interior.

Each of the carriers 402, 404, 406 has a top wall 408, bottom wall 410, and four side walls 412, 414, 416, and 418, with two opposing end side walls 412, 416, and two opposing longitudinal side walls 414, 418. In the four-cup version, the side walls 412, 414, 416, 418 are of equal size. In contrast, the end side walls 412, 416 of the eight-cup carrier 404 and the twelve-cup carrier 400 are shorter than the longitudinal side walls 414, 418. Ideally, the end side walls 412, 416 have handholds in the form of openings 420. The shape of the openings 420 may be of any aesthetically pleasing shape.

In the top walls 408 there is a plurality of drink cup openings 422, preferably having an octagonal planform shape with eight straight edges 424 that circumscribe each opening 422. A plurality of straw openings 426 is also included, positioned at aesthetically pleasing locations between the drink cup openings 422. In one implementation there are three straw openings 426 in the twelve-cup carrier 400, two straw openings 426 in the eight-cup carrier 402, and one centrally disposed straw opening 426 in the four-cup carrier 404. It is to be understood that more or less straw openings 426 may be used as desired. The diameter of each straw opening 426 as well as the other straw openings 112, 113 described in earlier implementations above may be sized to hold one straw or multiple straws, depending on the desired size of the straw openings 426, 112, 113 and the available space. Handholds in the form of openings in either the end side walls or the longitudinal side walls may also be included as described in the embodiment above.

These non-foldable carriers 400, 402, 404 are preferably formed of a poly material, and it can be manufactured with all resin adhered products. More particularly, examples of suitable poly materials would be polypropylene (sonic welded), polyethylene lined, polystyrene enhanced, and polyactic acid, and any combination of the foregoing. Graphics and other advertising indicia may be added to any of the top, bottom, and side walls as desired.

The various implementations described above can be combined to provide further implementations. Aspects of the implementations can be modified, if necessary to employ concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A foldable carrier for drink cups, the carrier comprising:

a single sheet of foldable material comprising:

a top panel having a front bend line, a rear bend line, a right bend line, and left bend line, the top panel having a plurality of drink cup openings;

a front panel extending from the front bend line on the top panel;

a rear panel flap extending from the rear bend line on the top panel;

a right side exterior flap extending from the right bend line on the top panel;

a bottom panel having a bottom front bend line, a bottom rear bend line, a bottom right bend line, and a bottom left bend line, the bottom panel extending from the front panel at the bottom front bend line;

a right side interior flap extending from the bottom right bend line on the bottom panel;

a left side interior flap extending from the bottom left bend line on the bottom panel;

a rear support panel extending from the bottom rear bend line on the bottom panel;

the top panel structured to fold over the bottom panel to place the foldable carrier in a folded configuration in which the top panel is positioned in alignment with the bottom panel; and a right back tab extending from the rear panel flap, a left back tab extending from the rear panel flap, a right back tab slit formed in the bottom rear bend line, and a left back tab slit formed in the bottom rear bend line, the left back tab and right back tab sized and shaped to be slidably received in the right back tab slit and left back tab slit, respectively, to hold the top panel in place and the foldable carrier in the folded configuration.

2. The foldable carrier of claim 1 further comprising at least one opening in the top panel sized and shaped to accommodate a plurality of straws corresponding in number to a number of the plurality of drink cup openings in the top panel.

3. The foldable carrier of claim 1 wherein each opening in the plurality of drink cup openings in the top panel includes at least one bendable tab extending from the top panel into the opening, the at least one bendable tab sized and shaped to frictionally engage the drink cup.

4. A foldable carrier for drink cups, the carrier comprising:

a single sheet of foldable material comprising:

a top panel having a front bend line, a rear bend line, a right bend line, and left bend line, the top panel having a plurality of drink cup openings;

a front panel extending from the front bend line on the top panel;

a rear panel flap extending from the rear bend line on the top panel;

a right side exterior flap extending from the right bend line on the top panel;

a bottom panel having a bottom front bend line, a bottom rear bend line, a bottom right bend line, and a bottom left bend line, the bottom panel extending from the front panel at the bottom front bend line;

a right side interior flap extending from the bottom right bend line on the bottom panel;

a left side interior flap extending from the bottom left bend line on the bottom panel;

a rear support panel extending from the bottom rear bend line on the bottom panel;

the top panel structured to fold over the bottom panel to place the foldable carrier in a folded configuration in which the top panel is positioned in alignment with the bottom panel; and a left side tab slit formed in the bottom left bend line on the bottom panel, a right side tab slit formed in the bottom right bend line on the bottom panel, a left side tab extending from a left side exterior flap on the top panel, and a right side tab extending from the right side exterior flap, the left side tab and right side tab sized and shaped to be slidably received in the left side tab slit and the right side tab slit, respectively, to hold the top panel in place and hold the foldable carrier in the folded configuration.

5. A foldable carrier for drink cups, the carrier comprising:

a single sheet of foldable material comprising:

a top panel having a front bend line, a rear bend line, a right bend line, and left bend line, the top panel having a plurality of drink cup openings;

a front panel extending from the front bend line on the top panel;

a rear panel flap extending from the rear bend line on the top panel;

a right side exterior flap extending from the right bend line on the top panel;

a bottom panel having a bottom front bend line, a bottom rear bend line, a bottom right bend line, and a bottom left bend line, the bottom panel extending from the front panel at the bottom front bend line;

a right side interior flap extending from the bottom right bend line on the bottom panel;

a left side interior flap extending from the bottom left bend line on the bottom panel;

a rear support panel extending from the bottom rear bend line on the bottom panel;

the top panel structured to fold over the bottom panel to place the foldable carrier in a folded configuration in which the top panel is positioned in alignment with the bottom panel; and a top right hand hold opening formed in the right side exterior flap, a top left hand hold opening formed in a left side exterior flap, a right side hand hold opening formed in the right side interior flap, a left side hand hold opening formed in the left side interior flap, the top right hand hold opening and the right side hand hold opening structured to overlap and the top left hand hold opening and the left side hand hold opening structured to overlap when the foldable carrier is in the folded configuration.

6. A foldable carrier for drink cups, the carrier comprising:

a single sheet of foldable material comprising:

a top panel having a front bend line, a rear bend line, a right bend line, and left bend line, the top panel having a plurality of drink cup openings;

a front panel extending from the front bend line on the top panel;

a rear panel flap extending from the rear bend line on the top panel;

a right side exterior flap extending from the right bend line on the top panel;

a bottom panel having a bottom front bend line, a bottom rear bend line, a bottom right bend line, and a bottom left bend line, the bottom panel extending from the front panel at the bottom front bend line;

a right side interior flap extending from the bottom right bend line on the bottom panel;

a left side interior flap extending from the bottom left bend line on the bottom panel;

a rear support panel extending from the bottom rear bend line on the bottom panel;

the top panel structured to fold over the bottom panel to place the foldable carrier in a folded configuration in which the top panel is positioned in alignment with the bottom panel; and wherein the right side interior flap has a right side front angled corner edge and a right side rear angled corner edge, and the left side interior flap has a left side front angled corner edge and a left side rear angled corner edge, and further wherein the front panel has a right side angled corner edge and a left side angled corner edge that are sized and shaped to butt against the right side front angled corner edge and the left side front angled corner edge, respectively, in response to the top panel being folded over the bottom panel.

7. The foldable carrier of claim 6 wherein the right side front angled corner edge and the left side front angled corner edge on the right side and left side interior flaps, respectively, and the right side angled corner edge and the left side angled corner edge on the front panel are all formed at a 45-degree angle to the bottom front bend line, and the right side rear angled corner edge and the left side rear angled corner edge on the right side and left side interior flaps, respectively, are formed at a 45-degree angle to the bottom rear bend line.

8. The foldable carrier of claim 6 wherein the rear panel flap has a right side top angled corner edge and a left side top angled corner edge that are sized and shaped to butt against the right side rear angled corner edge and the left side rear angled corner edge, respectively, when the top panel is folded over the bottom panel.

9. The foldable carrier of claim 8 wherein the right side top angled corner edge and the left side top angled corner edge are formed at a 45-degree angle to the right bend line and the left bend line, respectively.

10. The foldable carrier of claim 8 wherein the right side interior flap has a right side interior corner adjacent the right side front angled corner edge and the left side interior flap has a left side interior corner adjacent the left side front angled corner edge, and further wherein the front panel has a right side exterior corner adjacent the right side angled corner edge and a left side exterior corner adjacent the left side angled corner edge that are sized and shaped to fit within the right side interior corner and left side interior corner, respectively, when the top panel is folded over the bottom panel.

11. The foldable carrier of claim 10 wherein the right side interior flap has a right side rear interior corner adjacent the right side rear angled corner edge and the left side interior flap has a left side rear interior corner adjacent the left side rear angled corner edge, and further wherein the rear panel flap has a right side top exterior corner adjacent the right side top angled corner edge and a left side top exterior corner adjacent the left side top angled corner edge, the right side top exterior corner and the left side top exterior corner are sized and shaped to fit within the right side rear interior corner and the left side rear interior corner when the top panel is folded over the bottom panel and the foldable carrier is in the folded configuration.

12. The foldable carrier of claim 11 wherein the right side top exterior corner on the rear panel flap forms a 135-degree angle with the adjacent right side top angled corner edge and the left side top exterior corner forms a 135-degree angle with the adjacent left side top angled corner edge, and further wherein the right side exterior corner on the front panel forms a 135-degree angle with the adjacent right side angled corner edge, and the left side exterior corner on the front panel forms a 135-degree angle with the adjacent left side angled corner edge.

13. A foldable carrier for drink cups, the carrier comprising:

a single sheet of foldable material comprising:

a top panel having a plurality of drink cup openings;

a front panel extending from the top panel;

a bottom panel extending from the front panel;

a rear support panel extending from the bottom panel;

the top panel structured to fold over the bottom panel to place the foldable carrier in a folded configuration in which the top panel is positioned in alignment with the bottom panel;

a right side interior flap extending from a bottom right bend line on the bottom panel;

a left side interior flap extending from a bottom left bend line on the bottom panel;

wherein the right side interior flap has a right side front angled corner edge and a right side rear angled corner edge, and the left side interior flap has a left side front angled corner edge and a left side rear angled corner edge, and further wherein the front panel has a right side angled corner edge and a left side angled corner edge that are sized and shaped to butt against the right side front angled corner edge and the left side front angled corner edge, respectively, in response to the top panel being folded over the bottom panel.

14. The foldable carrier of claim 13 wherein each of the plurality of drink cup openings in the top panel includes at least one bendable tab extending from the top panel into the respective drink cup opening, the at least one bendable tab sized and shaped to frictionally engage the drink cup.

* * * * *